United States Patent [19]

Ehrat

[11] Patent Number: 4,566,694

[45] Date of Patent: Jan. 28, 1986

[54] MAGNETIC GAME

[76] Inventor: Kurt Ehrat, Grebweg 17, CH-8162, Steinmaur, Switzerland

[21] Appl. No.: 522,060

[22] Filed: Aug. 10, 1983

[30] Foreign Application Priority Data

Aug. 14, 1982 [CH] Switzerland ..... 4903/82

[51] Int. Cl.[4] ..... A63F 7/06; A63F 7/24; A63H 30/00

[52] U.S. Cl. ..... 273/1 GB; 273/1 GD; 273/85 F

[58] Field of Search ..... 273/1 GB, 1 GD, 1 M, 273/85 F; 446/131-136

[56] References Cited

U.S. PATENT DOCUMENTS

| | | | |
|---|---|---|---|
| 3,091,459 | 5/1963 | Lindman | 273/1 GD X |
| 3,827,692 | 8/1974 | Morrison | 273/85 F |
| 3,937,469 | 2/1976 | Cohen | 273/85 F |
| 3,961,791 | 6/1976 | Etchegoyhen | 446/136 X |

FOREIGN PATENT DOCUMENTS

| | | | |
|---|---|---|---|
| 967189 | 5/1975 | Canada | 273/85 F |
| 2009165 | 9/1970 | Fed. Rep. of Germany | 273/16 B |
| 2037526 | 2/1972 | Fed. Rep. of Germany | 273/85 F |

*Primary Examiner*—Paul E. Shapiro
*Attorney, Agent, or Firm*—Peter K. Kontler

[57] ABSTRACT

A magnetic game wherein the playing field between a light-transmitting top wall and a bottom wall which is parallel to the top wall receives one or more playing pieces including one or more permanent magnets. The playing piece(s) can be attracted or repelled by an impeller having at least one shifting member with a permanent magnet adjacent to the upper side of the top wall. The shifting member is movable by a handle which is provided thereon or by manipulating an elongated arm a light-transmitting portion of which overlies the top wall. The impeller can be assembled of two or three shifting members, one above the top wall, another below the bottom wall or between the top and bottom walls, and a third between the top and bottom walls or below the bottom wall. Such shifting members can define a pocket which can receive a portion of or the entire playing piece when the distance between the magnet of such playing piece and the magnet or magnets of the impeller is reduced below a critical value.

41 Claims, 50 Drawing Figures

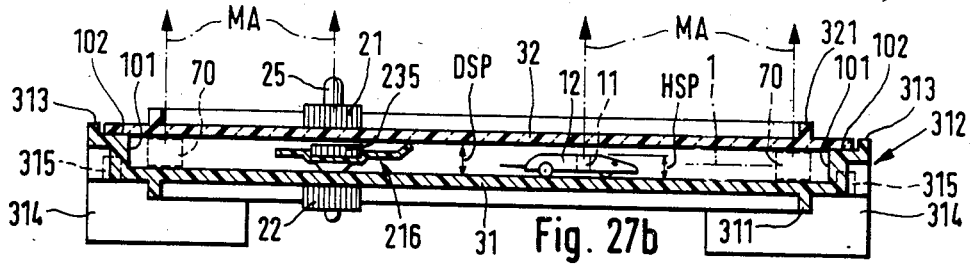
Fig. 27b
Fig. 27a
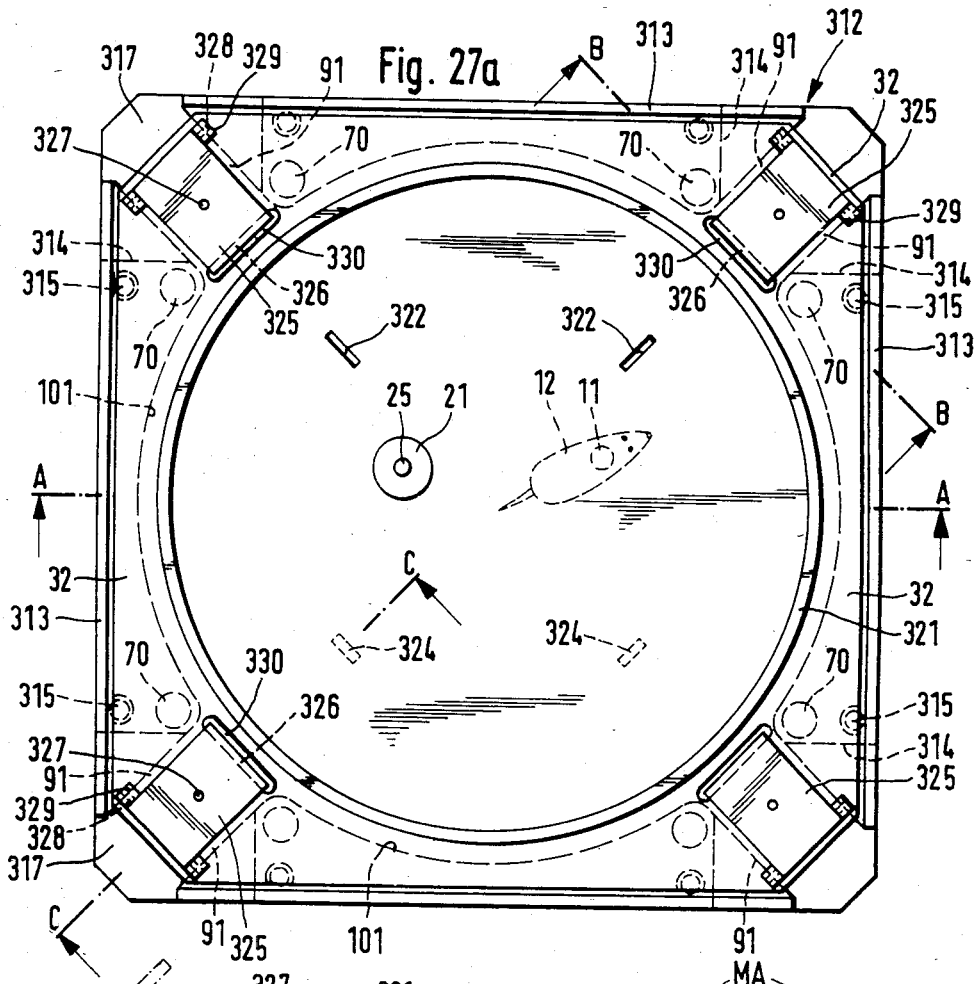
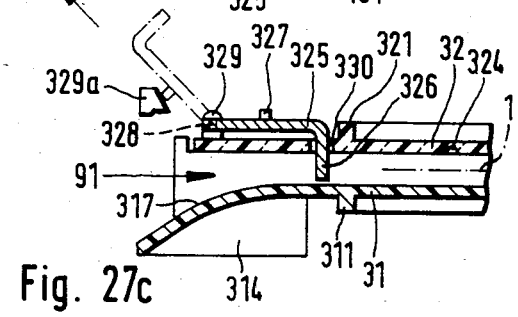
Fig. 27c
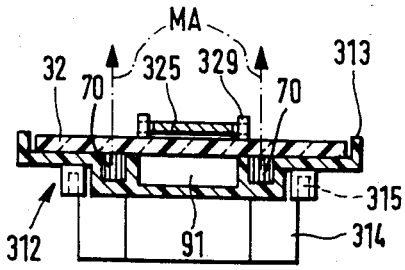
Fig. 27d

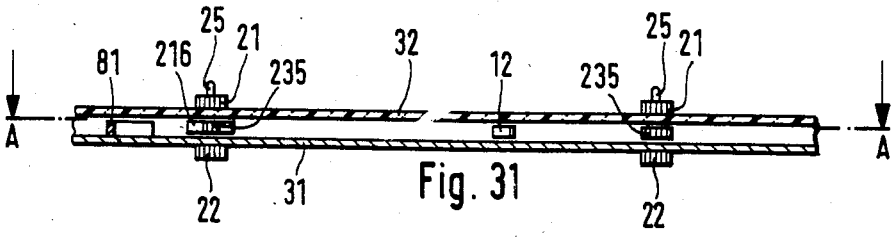
Fig. 31
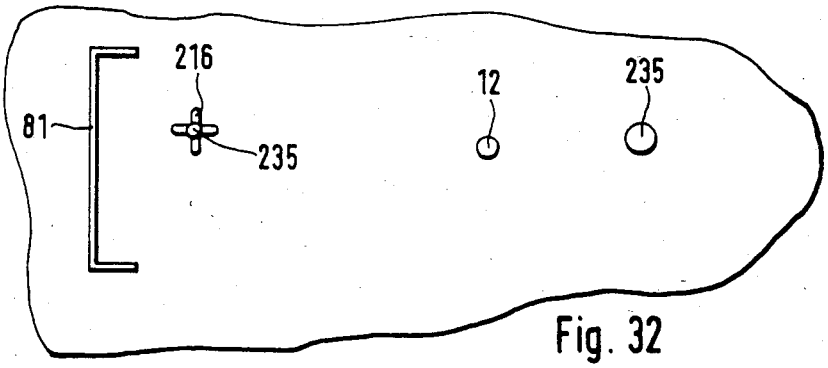
Fig. 32
Fig. 33
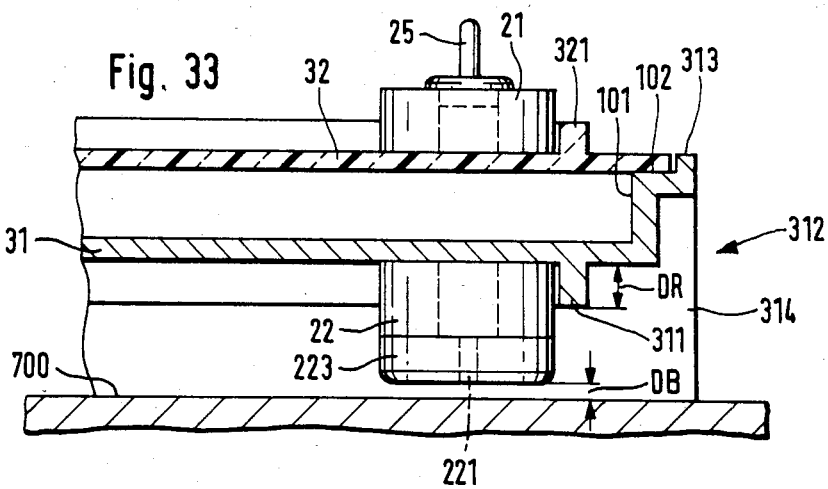

MAGNETIC GAME

BACKGROUND OF THE INVENTION

The present invention relates to games in general, and more particularly to improvements in magnetic toys, games or game devices of the type wherein one or more playing pieces are confined in an enclosure between two spaced-apart parallel walls and such playing pieces can be moved relative to the walls by one or more impellers in the form of or including permanent magnets.

It is already known to propel playing pieces, which include permanent magnets and are disposed at one side of a nonmagnetic wall, by one or more permanent magnets constituting impeller means at the other side of such wall. The impeller means can serve to attract the playing piece or pieces, for example, in a manner as disclosed in U.S. Pat. No. 2,668,389. In accordance with another prior proposal, the impeller means serves to repel the playing piece or pieces; reference may be had to U.S. Pat. No. 3,214,171 or to German Pat. No. 836,462. German Offenlegungsschrift No. 24 30 826 discloses a different magnetic game wherein each of several players manipulates two permanent magnets having different polarities and disposed in different planes. The playing pieces constitute or include permanent magnets having different polarities so that one magnet in the hands of a player attracts playing pieces having a first polarity and the other magnet in the hands of the same player attracts playing pieces having a different second polarity.

A drawback of the above outlined games is their limited versatility because all the players can do is to repel or attract the playing pieces. This becomes boring after a relatively short period of use.

OBJECTS AND SUMMARY OF THE INVENTION

An object of the invention is to provide a novel and improved magnetic game or toy which employs permanent magnets and whose versatility greatly exceeds the versatility of heretofore known magnetic games.

Another object of the invention is to provide a magnetic game which is simple, compact and inexpensive, and which can be utilized to imitate a wide variety of sports activities, behavior and characteristic activities of animals, behavior and activities of mythical figures and/or many others.

A further object of the invention is to provide a magnetic game which can be constructed and assembled in such a way that the impeller or impellers either attract or repel one or more playing pieces or figures and which can be entertaining to small children, teenagers or adults.

An additional object of the invention is to provide a magnetic game which is particularly suited to imitate the cat-and-mouse play or any similar play wherein a predator or a lawman attempts to capture a much weaker but highly elusive victim or culprit.

A further object of the invention is to provide a magnetic game which can be used to drive one or more playing pieces along one or more preselected more or less intricate paths in imitation of a slalom skier, a dribbling soccer player, the driver of a racing car or the like.

An additional object of the invention is to provide a novel and improved playing board for use in a magnetic game of the above outlined character.

A further object of the invention is to provide a novel and improved (simple or composite) impeller for use in the above outlined magnetic game.

Another object of the invention is to provide novel and improved playing pieces for use with the improved impeller and in or on the improved board.

A further object of the invention is to provide a magnetic game which need not or does not consume any energy other than that of the participants.

An additional object of the invention is to provide a novel and improved method of manipulating one or more playing pieces in a magnetic game of the above outlined character.

Still another object of the invention is to provide a novel and improved method of manipulating the impeller in a game of the above outlined character.

A further object of the invention is to provide a magnetic game which can be rapidly converted for play with different playing pieces and with resort to different impellers.

Another object of the invention is to provide a magnetic game whose versatility is practically inexhaustible and wherein such high versatility is achieved by resorting to a relatively small number of extra parts.

An additional object of the invention is to provide a magnetic game which can be played indoors or outdoors because it does not require its own energy source and which can be produced in any one of a large number of different sizes and/or shapes depending on the age group of the contemplayed player or players and on numerous other factors such as the sex of the player or players and/or the availability of space for the storage or setting up of the game.

A further object of the invention is to provide a magnetic game which can be played by a single person or simultaneously or seriatim by two or more persons.

The invention is embodied in a magnetic game which comprises a playing board having spaced apart parallel top and bottom walls (at least the top wall consists of a light-transmitting material), and at least one playing piece (e.g., in the form of an animal or a vehicle) disposed between the two walls and including at least one permanent magnet. The playing piece is movable between and along the two walls which are arranged to hold the playing piece against tilting so that the polar axis of the magnet is invariably at least substantially perpendicular to the two walls, and the game further comprises impeller means including at least one manually movable shifting member which is outwardly adjacent to one of the walls and includes at least one first permanent magnet having a polar axis which is perpendicular to the two walls. The direction of magnetization of the magnets is identical and the shifting member is movable along the outer side of the respective wall to thereby effect a movement of the playing piece between the walls. The impeller means preferably comprises a second shifting member having at least one second permanent magnet whose polar axis is perpendicular to the two walls and which is separated from the first magnet by at least one of the walls. For example, the one shifting member can constitute a first shifting member which is outwardly adjacent to the top wall and the second shifting member can be adjacent to the outer side of the bottom wall. Such shifting members are in register with one another and are movable substantially as a unit along the outer sides of the respective walls. The first and second shifting members can be magnetically or mechanically coupled to one another. The mechanical coupling means can comprise first and second arms which respectively carry the first and second shifting members and extend outwardly beyond a boundary which surrounds the two walls, and connector means for preferably separably securing the two arms to one another in a region which is outwardly adjacent to the boundary. The arm for the first shifting member preferably includes a light-transmitting portion which overlies the top wall, and such light-transmitting portion of the arm for the first shifting member preferably consists of a synthetic plastic material.

The game can further comprise guide means (such as an elongated rail) defining an elongated path wherein the connector means is movable toward and away from the boundary of the board. The arms are preferably turnable about an axis which is defined by the connector means and is perpendicular to the two walls so that the shifting members can be caused to perform translatory as well as angular movements with reference to the respective walls. The boundary of the board can be provided with a socket serving to removably receive a portion of the guide means so that the latter can be stored away from the board.

The impeller means can comprise one, two or three shifting members. If the impeller means comprises two shifting members, the first shifting member is preferably adjacent to the outer side of the top wall and the second shifting member is disposed between the two walls or is outwardly adjacent to the bottom wall. If the impeller means comprises three shifting members, the first is preferably adjacent to the outer side of the top wall, the second is preferably adjacent to the outer side of the bottom wall, and the third is then disposed between the two walls intermediate the first and second shifting members. The third shifting member comprises at least one third permanent magnet whose polar axis is perpendicular to the walls and which is magnetically coupled to the permanent magnet or magnets of the first and/or second shifting member. At least one of the shifting members can comprise at least one rotary element which is in rolling engagement with the adjacent wall. Such rotary element can be constructed and mounted to maintain the magnet or magnets of the respective shifting member out of direct contact with the adjacent wall. The rotary element may comprise or constitute a caster. The first and second shifting members can comprise registering or overlapping marginal portions which extend beyond the third shifting member so that the two marginal portions and the third shifting member define a pocket which is disposed between the two walls and serves to receive a portion of or an entire playing piece. The distribution of poles and flux lines of the magnets of the playing piece and of the shifting members is preferably such that the magnet of the playing piece is repelled when the distance between the magnet of the playing piece and the magnets of the first and second shifting members exceeds a predetermined (critical) value and that the magnet of the playing piece is attracted by the magnets of the first and second shifting members and urges the playing piece into the pocket when the distance between the magnet of the playing piece and the magnets of the first and second shifting members is reduced below the predetermined value. The third shifting member can be provided with a nonmagnetic component which serves to prevent a playing piece from approaching the third shifting member except by way of the pocket.

The magnet of each of the first and second shifting members can constitute a substantially round disc having a flat side which is adjacent to the respective wall, and each such shifting member can resemble an animal (e.g., a cat or a dragon attempting to devour a mouse or another animal represented by the playing piece). The magnet of the third shifting member can also constitute a flat disc which is formed with a peripheral flat; the pocket is then adjacent to such flat and the nonmagnetic component of the third shifting member can comprise two jaws flanking the flat. A tail portion of the component extends beyond the magnets of the first and second shifting members and is located substantially diametrically opposite the flat. Such third shifting member can further comprise a leaf spring or other suitable resilient means serving to bear against one of the walls and to urge the tail portion against the other wall.

If the first and/or second and/or third shifting member comprises one or more rotary elements and the magnet of such shifting member has a substantially circular outline, the rotary element is preferably disposed within the circular outline. If the third shifting member has a substantially circular magnet, such magnet is preferably held out of direct contact with the walls and can be provided with a bore extending at right angles to the walls and accommodating at least two spherical rolling elements one of which contacts the inner side of the top wall and the other of which contacts the inner side of the bottom wall.

If the playing piece is elongated, the respective permanent magnet is preferably nearer to one than the other end of such playing piece. This is desirable if the playing piece is a vehicle or a replica of an animal because the head or front part of the playing piece then always tends to lead, as considered in the direction of movement of the playing piece, when the latter is approached by the shifting member(s). If the playing piece comprises a head or front part and a rear part, it can be provided with a caster in the region of the front part and with several wheels in the region of the rear part. The head part is preferably narrower than the rear part if the shifting members define a pocket, and the dimensions of the pocket can be selected in such a way that it can receive the head part but not the rear part of the playing piece.

The boundary of the board can comprise circular or polygonal fences extending outwardly beyond the outer sides of the top and bottom walls to thus limit the extent of movability of the first and second shifting members with reference to and along the respective walls. The board can be further provided with at least one sealable outlet which allows for evacuation of the playing piece or pieces from the space between the top and bottom walls. Additional permanent magnets can be provided in or on the boundary to flank the outlet or outlets, and the polar axes of such additional magnets are preferably perpendicular to the two walls. The additional permanent magnets are preferably disposed at a level between the two walls. The boundary can be made of a suitable synthetic plastic material and can be integral with at least one of the walls, preferably with the bottom wall. Moreover, the boundary can comprise one or more ground-, floor- or table-contacting legs. The top wall is preferably separable from the boundary and the latter can be provided with shoulders, recesses or other suitable means for locating the properly inserted top wall at an optimum distance from and in optimum orientation with reference to the bottom wall. If the boundary has a polygonal outline with several corners, and if such boundary is provided with several outlets, each outlet is preferably located in a different corner of the boundary. Pivotable gates can be employed to seal or expose the outlets so that the exposed outlets can permit one or more playing pieces to pass therethrough. The inner side of the top wall can be provided with a recess in front of each outlet to facilitate expulsion of playing pieces. Such recess(es) can extend in the longitudinal direction or transversely of the respective outlet(s). Each outlet is preferably elongated and preferably extends radially of the top wall if the latter constitutes or includes a circular or substantially circular plate.

Still further, the game can comprise an insert which can be placed into the space between the two walls. Such insert can comprise a relatively thin panel which is placed against the bottom wall and at least one projection (e.g., the cage of a hockey rink or the goal of a soccer field) which extends from the panel toward the top wall.

The insert can further comprise means defining at least one proposed path for movements of a playing piece under the influence of the shifting members. For example, such path defining means can be a line drawn on the aforementioned panel and denoting the route a slalom skier should take through a series of suitably distributed gates toward the finish line. The projection may constitute a stop (or the insert can be provided with a stop in addition to the aforementioned projection or projections) against which the playing piece can be manipulated by the shifting members so that the shifting members can be moved relative to the playing piece while the latter bears against the stop.

The novel features which are considered as characteristic of the invention are set forth in particular in the appended claims. The improved magnetic game itself, however, both as to its construction and the mode of using the same, together with additional features and advantages thereof, will be best understood upon perusal of the following detailed description of certain specific embodiments with reference to the accompanying drawing.

BRIEF DESCRIPTION OF THE DRAWING

FIG. 27*a* is a plan view of a modified magnetic game with a polygonal playing board which comprises two polygonal walls;

FIG. 27*b* is a sectional view as seen in the direction of arrows from the line A—A of FIG. 27*a;*

FIG. 27*c* is a fragmentary sectional view as seen in the direction of arrows from the line C—C of FIG. 27*a;*

FIG. 27*d* is a fragmentary sectional view as seen in the direction of arrows from the line B—B of FIG. 27*a;*

FIG. 31 is a fragmentary sectional view of a magnetic game which employs the insert of FIG. 29 or an analogous insert;

FIG. 32 is a plan view of a portion of the structure which is illustrated in FIG. 31 as seen in the direction of arrows from the line A—A of FIG. 31; and FIG. 33 is an enlarged view of a detail of a further magnetic game in a section similar to that of FIG. 27*b.*

DESCRIPTION OF THE PREFERRED EMBODIMENTS

Figure 1A:
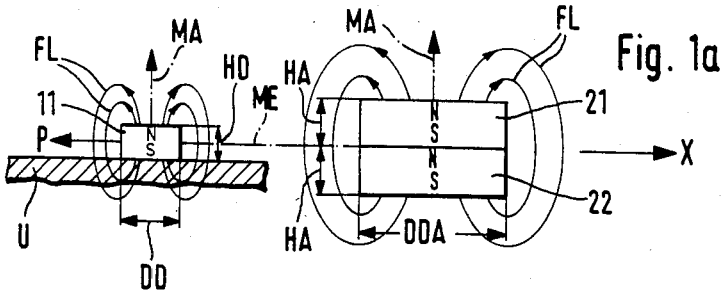
FIG 1*a* is a schematic side elevational view of a playing piece and of two coaxial disc-shaped shifting members which can cause the playing piece to move away therefrom along the flat upper side of a support.

FIG. 1*a* illustrates schematically the principle of operation of one embodiment of a magnetic playing game. The reference character 11 denotes a cylindrical or round disc-shaped permanent magnet which forms part of a playing piece and the flat bottom surface of which rests on the smooth horizontal top surface of a support U. The two poles of the permanent magnet 11 are respectively shown at N and S. The reference characters FL denote the lines representing the magnetic flux (hereinafter called flux lines); the height or axial length of the permanent magnet 11 is indicated at HD; and the diameter of the magnet 11 is indicated at DD. Since the height HD is less than the diameter DD, the permanent magnet 11 is not likely to be tilted when it is caused to slide along the top surface of the support U, for example, in the direction indicated by the arrow P. The polar or magnetization axis MA of the permanent magnet 11 is perpendicular to the plane of the upper surface of the support U.

FIG. 1*a* further shows two abutting flat cylindrical or round disc-shaped permanent magnets 21, 22 whose polarization is the same as that of the permanent magnet 11. The flux lines of the magnets 21, 22 are denoted by the reference characters FL. The right-hand polar axis MA is common to the two permanent magnets 21, 22 and is parallel to the similarly referenced polar axis of the permanent magnet 11, and each of the magnets 21, 22 has an axial length HA which somewhat exceeds the axial length HD of the permanent magnet 11. The magnets 21, 22 abut against each other in a central plane ME which is indicated by a phantom line and is disposed midway between the planes of the two end faces of the permanent magnet 11. The magnetic force which is produced by the abutting permanent magnets 21, 22 is identical to that of a single permanent magnet having the same diameter DDA and a height or axial length 2HA. In the coordinate system of FIG. 1*a* (only the X-axis is shown), the permanent magnets 21, 22 repel the smaller permanent magnet 11 in the direction indicated by the arrow P, namely, in a direction to the left, as viewed in FIG. 1*a*. If the repelling force is sufficient, the flat bottom end face of the permanent magnet 11 slides along the preferably smooth top surface of the support U and the magnet 11 advances in the direction indicated by the arrow P. The permanent magnets 21, 22 can "chase" the permanent magnet 11 by moving counter to the direction indicated by the arrow X.

Figure 1B:
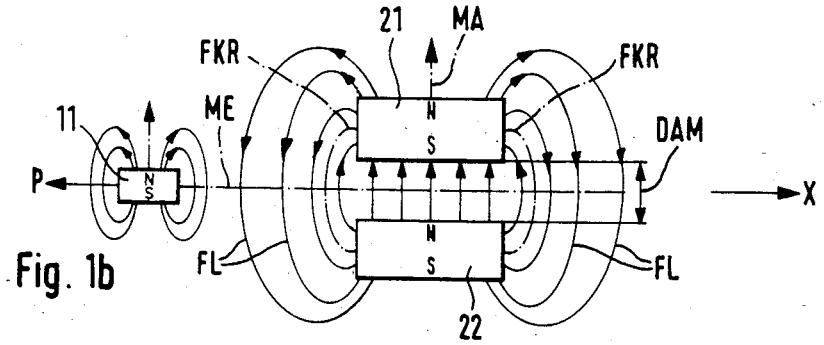
FIG 1*b* is a similar schematic side elevational view but showing the shifting members in different positions with reference to one another so that they can selectively attract or repel the playing piece.

FIG. 1*b* illustrates a modified magnetic game wherein the orientation and dimensions of the permanent magnets 11, 21, 22 are the same or substantially the same as shown in and described with reference to FIG. 1*a*. The difference between the two embodiments is that, in FIG. 1*b*, the coaxial permanent magnets 21, 22 of the impeller of the game are spaced apart as considered in the direction of their common polar axis MA, by a distance DAM which exceeds the axial length or height HD of the smaller permanent magnet 11. The central plane ME is disposed midway between the neighboring end faces of the permanent magnets 21, 22 and midway between the end faces of the smaller permanent magnet 11. The direction of magnetization of each of the permanent magnets 11, 21, 22 shown in FIG. 1*b* is the same.

A comparison of FIGS. 1*a* and 1*b* will reveal that the progress of flux lines FL in FIG. 1*b* is the same as in FIG. 1*a* save for the flux lines which extend across the space or gap between the magnets 21 and 22. Each flux line FL which originates in the upper end face of the upper permanent magnet 21 proceeds along an arcuate path toward the lower end face of the permanent magnet 22. The flux lines FL which issue from the upper half of the cylindrical peripheral surface of the permanent magnet 21 progress downwardly toward the lower half of the cylindrical peripheral surface of the permanent magnet 22. Consequently, the permanent magnets 21 and 22 of FIG. 1*b* also tend to repel the smaller permanent magnet 11 in the direction which is indicated by the arrow P, namely, in a direction to increase the distance between the playing piece which includes the permanent magnet 11 and the impeller which comprises two shifting members, namely, an upper shifting member including the permanent magnet 21 and a lower shifting member including the permanent member 22.

FIG. 1*b* further shows, that due to the establishment of a gap between the permanent magnets 21 and 22 of the impeller, the progress of flux lines FL in the region within and immediately adjacent such gap is counter to the direction of progress of the remaining (outer) flux lines. The relatively short flux lines issue from the upper end face and from the upper half of the cylindrical peripheral surface of the lower permanent magnet 22 and progress toward the lower end face as well as toward the lower half of the cylindrical peripheral surface of the upper permanent magnet 21. Consequently when the permanent magnets 21, 22 are caused to approach the permanent magnet 11 or vice versa, the permanent magnets 21 and 22 begin to attract the permanent magnet 11 as soon as the latter crosses an imaginary border which is indicated by the phantom lines FKR and can be said to constitute a substantially barrel-shaped imaginary surface having its upper edge midway between the upper and lower axial ends of the peripheral surface of the permanent magnet 21 and its lower edge midway between the upper and lower axial ends of the peripheral surface of the lower permanent magnet 22. The structure which is shown in FIG. 1*b* can cause the permanent magnet 11 to move away from the permanent magnets 21, 22 (in the direction indicated by the arrow P), to remain at a fixed distance DKR (see FIG. 1*d*) from the common polar axis MA of the permanent magnets 21, 22, or to be "captured" by the permanent magnets 21, 22 within the space which is surrounded by the imaginary border FKR (i.e., the smaller permanent magnet 11 is then held in the gap between the neighboring end faces of the permanent magnets 21 and 22).

Since FIG. 1*b* does not show any means for preventing a change of orientation of the relatively small permanent magnet 11 with reference to the larger permanent magnets 21, 22, the smaller permanent magnet 11 would normally change its orientation (i.e., it would be tilted) and would be attracted to one of the permanent magnets 21, 22. In order to prevent such undesirable change of orientation (tilting) of the smaller permanent magnet 11, the latter is preferably placed between two parallel horizontal walls 31, 32 (FIG. 1*c*) the mutual spacing of which is indicated at DSP. Such spacing slightly exceeds the axial length HD of the permanent magnet 11 between the inner sides of the walls 31 and 32. At least the upper wall or top wall 32 is capable of transmitting light so that a person looking at the structure of FIG. 1*c* from above can observe the position and the direction of propagation of the permanent magnet 11. The central plane ME is disposed at least substantially midway between the inner sides of the walls 31 and 32, and the larger permanent magnets 21, 22 have a common polar axis MA. This axis is parallel to the polar axis MA of the smaller permanent magnet 11 and is perpendicular to the planes of the walls 31 and 32. The distance DAM between the neighboring end faces of the permanent magnets 21, 22 slightly exceeds the distance DSA between the outer sides of the walls 31 and 32. Each of the permanent magnets 11, 21, 22 is assumed to constitute a short cylinder, i.e., a disc the axis of which is normal to the planes of the walls 31 and 32. The permanent magnet 21 is outwardly adjacent to the preferably transparent top wall 32, and the lower permanent magnet 22 is outwardly adjacent to the underside of the lower wall 31. The distance DSP between the inner sides of the walls 31 and 32 is less than the diameter DD of the permanent magnet 11; this prevents the magnet 11 from changing its orientation in the space or playing field 1 between the walls 31, 32 but enables the magnet 11 to travel toward or away from the magnets 21, 22, depending upon the momentary distance between 11 on the one hand and 21, 22 on the other hand. The feature that the distance DAM exceeds the distance DSA is desirable and advantageous because this eliminates friction between the permanent magnets 21, 22 and the respective walls 32, 31 so that the movements of the permanent magnets 21, 22 along the outer sides of the adjacent walls can be effected with a minimum of physical effort.

Figure 1C:
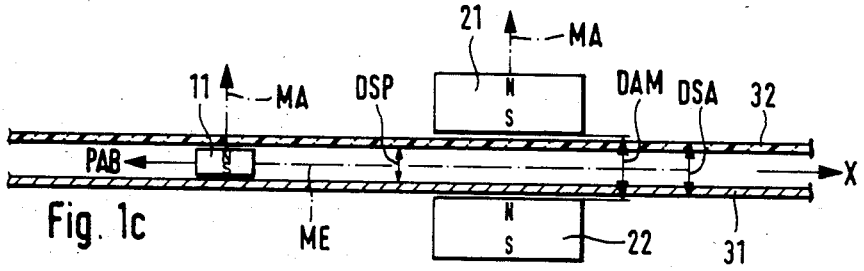
FIG. 1*c* illustrates the parts of FIG. 1*b* and in section two parallel walls which confine the playing piece and separate the two shifting members from one another, the shifting members being in the process of repelling the playing piece.

In FIG. 1*c*, the distance between the coaxial permanent magnets 21, 22 and the permanent magnet 11 of the playing piece is greater than the predetermined critical or fixed distance DKR. Therefore, the permanent magnets 21, 22 repel the smaller permanent magnet 11 in the direction indicated by the arrow PAB. In other words, the permanent magnets 21, 22 can "chase" the permanent magnet 11 by moving it in the direction counter to that indicated by the arrow X.

Figure 1D:
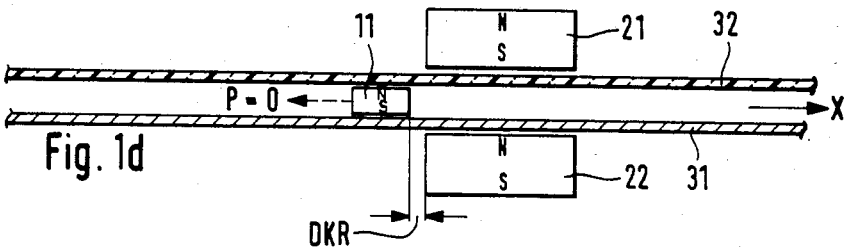
FIG. 1*d* illustrates the structure of FIG. 1*c* but with the shifting members moved nearer to the playing piece.

FIG. 1*d* shows that the smaller permanent magnet 11 is disposed at the critical distance DKR from the peripheral surfaces of the coaxial permanent magnets 21 and 22. Consequently, the force acting in the direction of the arrow P (indicated by broken lines) equals zero.

Figure 1E:
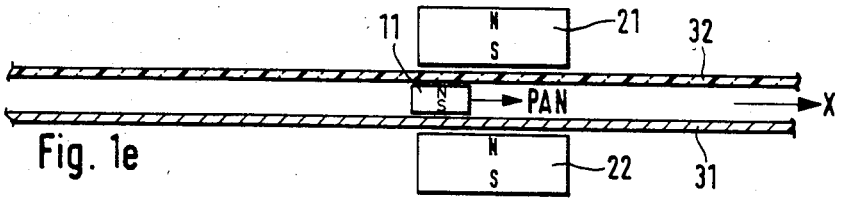
FIG. 1*e* illustrates the structure of FIG. 1*c* or 1*d* but with the playing piece attracted by and captured between the two shifting members.

FIG. 1*e* illustrates the permanent magnet 11 in the gap between the larger permanent magnets 21, 22. This is achieved by moving the permanent magnets 21, 22 from the positions shown in FIG. 1*d* in a direction away from that indicated by the arrow X so that the distance between the peripheral surfaces of the magnets 21, 22 and the peripheral surface of the magnet 11 is reduced to less than DKR. This results in a movement of the permanent magnet 11 in the direction indicated by the arrow PAN, and the magnet 11 thereupon remains confined between the magnets 21, 22 except by forcibly holding it against movement while the permanent magnets 21, 22 move in or counter to the direction indicated by the arrow X so that the distance between their peripheral surfaces and the peripheral surface of the permanent magnet 11 is again increased beyond DKR.

It will be noted that the structure which is shown in FIGS. 1*b* and 1*c*–1*e* is capable of effecting a movement of the magnet 11 away from or toward the magnets 21, 22, or a retention of the magnet 11 at a predetermined distance (DKR) from the magnets 21, 22.

Referring to FIGS. *2a–2d*, there is shown a complete magnetic game including a playing piece 12 resembling a mouse and an impeller comprising an upper shifting member having a permanent magnet 21 and a lower shifting member including a permanent magnet 22 which is coaxial with the permanent magnet 21. The parallel walls 31, 32 define a substantially circular playing field 1 in which the playing piece 12 is movable in any desired direction, depending on the direction of movement of the impeller by way of a handle 25 which is adjacent to and extends upwardly from the upper permanent magnet 21.

The permanent magnet 11 of the playing piece 12 is located nearer to the front than to the rear part of the playing piece, namely, in or close to the head or front portion of the animal which is represented by the piece 12. This ensures that the movement or shifting of the playing piece 12 between the walls 31 and 32 more closely resembles the natural movements of the animal which is supposed to be represented by the playing piece. The distance DSP between the inner sides of the walls 31, 32 at least slightly exceeds the height of the playing piece 12 so that the latter has freedom of movement within the playing field 1. As mentioned before, at least the top wall 32 consists of a light-transmitting material so that a person looking at the game from above can see the position of the playing piece 12 with reference to the upper permanent magnet 21. The magnets 21 and 22 have a common polar axis MA, and each of these magnets is assumed to constitute a short cylinder or a round disc having a diameter substantially exceeding the diameter of the preferably cylindrical or disc-shaped permanent magnet 11 in the playing piece 12. The playing piece 12 can consist of a suitable synthetic plastic material, and the permanent magnet 11 can be molded or otherwise permanently embedded in the material of such playing piece.

Friction between the rear part or tail part of the playing piece 12 and the upper side of the bottom wall 31 also contributes to a movement of the playing piece in imitation of the running of a mouse when it is approached by the permanent magnets 21, 22 of the coaxial shifting members forming part of the impeller of the magnetic game shown in FIGS. *2a–2e*.

It is clear that the bottom wall 31 can also consist of a light-transmitting material, such as acrylic glass. The utilization of an opaque bottom wall is often preferred because this facilitates the visual tracking of movements of the playing piece 12 in the playing field 1.

The means for moving or manipulating the permanent magnets 21, 22 of the two shifting members with reference to the outer sides of the respective walls 32, 31 comprises two elongated arms 23, 24 which are preferably separably secured to each other by a connection 28. One end portion of the upper arm 23 is connected to the permanent magnet 21 and carries the aforementioned handle 25, and the other end portion of the arm 23 is separably connected to the respective end portion of the lower arm 24 in a manner as shown in the left-hand portion of FIG. *2a* and in the right-hand portion of FIG. *2c*. At least that portion of the upper arm 23 which overlies the light-transmitting top wall 32 preferably consists of a light-transmitting material, preferably a suitable plastic substance.

The connection 28 can rigidly but separably secure the respective end portions of the arms 23, 24 to each other so that such arms maintain the corresponding permanent magnets 21, 22 at a requisite distance from the outer sides of the associated walls 32, 31. The reference character 222 denotes a pin, bolt, screw or an analogous fastener which permanently or separably secures the lower permanent magnet 22 to the respective end portion of the arm 24. The connection 28 is located outside of the playing field 1, namely outside of the region in which the playing piece 12 is movable under the influence of the permanent magnets 21, 22.

The connection 28 includes a ferromagnetic plate 231 which is recessed into the underside of the right-hand end portion of the upper arm 23, as viewed in FIG. *2c*, two fastening or locating pins 244 which extend upwardly from the horizontal end portion 242 of the arm 24 into complementary recesses in the underside of the arm 23 (or through the entire arm 23) and a permanent magnet 243 which is embedded into the upper side of the end portion 242 and can attract the ferromagnetic plate 231 so as to retain the pins 244 in the corresponding recesses of the arm 23. The end portion 242 is disposed at the upper end of a vertical portion 241 which forms part of the arm 24 and the lower end of which carries a round disc-shaped follower 245 forming an integral part of the lower arm 24 and being capable of performing translatory and rotary movements in an elongated channel-shaped guide rail 41. The rail 41 is separably connectable to the playing board 312 of the game shown in FIGS. *2a–2e*. To this end, the left-hand end portion of the rail 41, as viewed in FIG. *2d*, carries laterally outwardly extending reinforcing webs or fishplates 43 which carry pins 42 receivable in complementary sockets 315 of the playing board 312. The axis of the follower 245 constitutes a pivot axis about which the arms 23, 24 can turn while the follower 245 assumes a selected position in the elongated guide rail 41 or while the follower 245 performs a translatory movement from the one to the other end of the guide rail. In other words, each of the permanent magnets 21, 22 can perform a translatory as well as an angular movement with reference to the outer side of the corresponding wall 32, 31. This enables the operator, who grasps the handle 25, to shift the impeller including the permanent magnets 21, 22 in any desired direction within the confines determined by the configuration of the playing board 312.

The feature that the guide rail 41 is separably connected to the playing board 312 is desirable and advantageous because this renders it possible to reduce the overall dimensions of the magnetic game when the latter is not in actual use. Moreover, it is also convenient to the manufacturer because the game can be confined in a relatively small box.

The playing board 312 includes a boundary or marginal portion 313 which surrounds the walls 32, 31 and is preferably integral with the bottom wall 31. As can be seen in FIG. *2b*, the playing board 312 can have a substantially square outline; however it is equally possible to impart to this board another polygonal or a circular outline. The board 312 further includes a substantially ring-shaped fence 311 which extends downwardly from the underside of the bottom wall 31 and confines the lower permanent magnet 22 to movements within the region which is coextensive with the playing field 1. The playing board 312 further includes a second fence 321 which confines the movements of the upper permanent magnet 21 with reference to the top wall 32. The fence 321 can form an integral part of the major or main portion of the playing board 312, or (as shown in FIG. 2*a*) it can form an integral part of the light-transmitting wall 32.

The four corner portions of the playing board 312 are provided with downwardly extending legs 314 or analogous distancing elements which ensure that there is ample room for introduction of the lower arm 24 of the moving means for the impeller below the bottom wall 31 as well as for placing of the guide rail 41 to an optimum position with reference to the boundary 313 of the playing board 312. As can be seen in FIG. 2*a*, the underside of the guide rail 41 is flush with the bottom end faces of the legs 314. The magnetic game of FIGS. 2*a*–2*e* can be placed on the floor, onto the top surface of a table, or onto any other preferably horizontal support which ensures that the playing piece 12 does not exhibit any, or any pronounced, tendency to move by gravity within the confines provided therefor by the playing board 312.

The locating means for the removable (liftable) top wall 32 comprises a circular or polygonal platform 101 and a shoulder 102 at the upper end of the platform 101. The properly installed top wall 32 rests on the shoulder 102 and is held against movement in its own plane by the upwardly extending marginal portion of the boundary 313. In the embodiment of FIGS. 2*a*–2*e*, the top wall 32 has a substantially square outline with bevelled corner portions. However, it is equally within the purview of the invention to utilize a circular, hexagonal, octagonal or other polygonal top wall; all that is necessary to accommodate such wall in the playing board 312 is to impart appropriate configuration to the locating means 101, 102. As mentioned before, the distance DSP between the bottom wall 31 and the properly installed top wall 32 at least slightly exceeds the height of the playing piece 12. However, the difference need not be excessive because this would enable the playing piece 12 to tilt or to perform other stray movements with reference to the playing board 312.

Figures 2A, 2B, 2C, 2D, 2E:
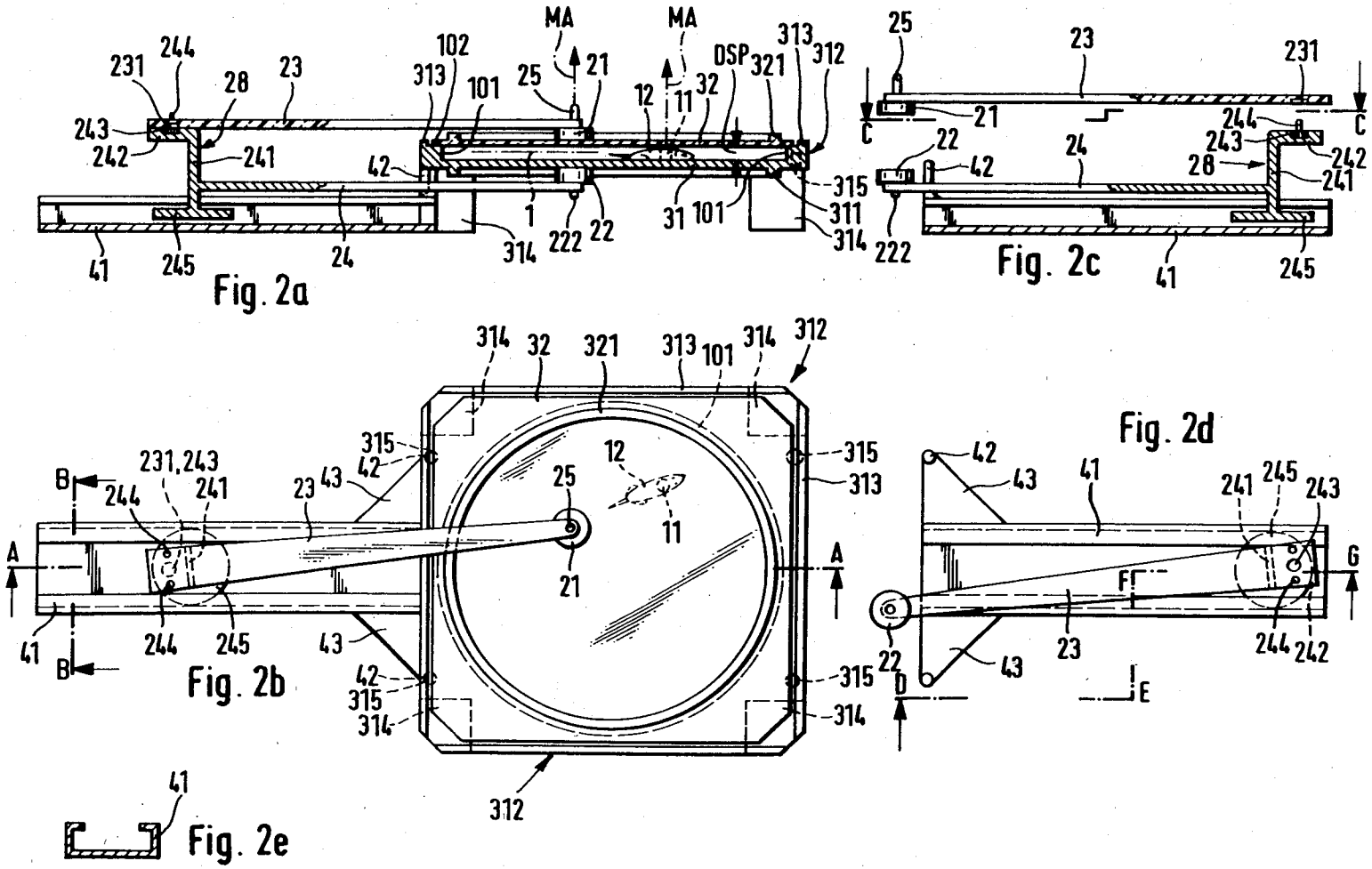
FIG. 2*a* illustrates the shifting members of FIGS. 1*b*–1*e*, a mouse-like playing piece between the two walls, the remainder of the playing board which is shown in section, and means for facilitating manual manipulation of the two shifting members, the section being taken in the direction of arrows as seen from the line A—A of FIG. 2*b;*
FIG. 2*b* is a plan view of the structure which is illustrated in FIG. 2*a;*
FIG. 2*c* shows the connection for the shifting members of the game which is shown in FIGS 2*a* and 2*b* in dismantled condition and with the lower arm and a guide rail therefor shown in section as seen from the line D-E-F-G of FIG. 2*d;*
FIG. 2*d* shows a portion of the structure of FIG. 2*c* in a plan view as seen in the direction of arrows from the line C—C of FIG. 2*c;*
FIG. 2*e* is a sectional view as seen in the direction of arrows from the line B—B of FIG. 2*b;*

FIG. 2*b* shows that the playing board 312 is formed with two sets of sockets 315 at two sides which are disposed opposite one another. This is desirable and advantageous because the playing board 312 can be connected with two discrete impellers, namely, with two discrete rails 41 each of which supports and guides a pair of arms 23, 24 for the corresponding permanent magnets 21 and 22. This can render the game more interesting because each of two contestants can attempt to steer a single playing piece 12 in a particular direction or to steer any one of two or more properly confined playing pieces in a selected direction. It is evident that the playing field 1 can accommodate two or more different playing pieces, for example mice having different sizes and/or shapes.

Detachment of a rail 41 from the playing board 312 merely necessitates extraction of the corresponding pins 42 from the associated sockets 315 in the corresponding portion of the boundary 313. The arms 23 are readily separable from the corresponding lower arms 24 by the simple expedient of extracting the fastening pins 244 from the recesses in the arms 23. This results in separation of the ferromagnetic plates 231 from the associated permanent magnets 243.

It is also within the purview of the invention to permanently connect the arms 23 and 24 of a moving means to one another as soon as the corresponding permanent magnets 21, 22 are properly positioned with reference to the respective walls 32, 31. However, a separable connection 28 between such arms is desirable and advantageous because it allows for convenient and rapid lifting of the top wall 32 away from the bottom wall 31. Such lifting of the top wall 32 will become necessary when the player or players wish to add or remove one or more playing pieces 12. Also, this facilitates convenient dusting of the surfaces surrounding the playing field 1.

The upper shifting member (including the permanent magnet 21) can resemble a cat so as to further enhance the eye-pleasing appearance of the magnetic game. The same holds true for the lower shifting member including the permanent magnet 22. These shifting members are moved in any desired direction by the handle 25 to thereby drive the "mouse" 12 in front of the impeller. The aforementioned positioning of the permanent magnet 11 in the front part of the body of the playing piece 12 ensures that the head of the "running" mouse invariably faces away from the corresponding permanent magnets 21, 22. The playing piece 12 will "flee" away from the impeller as long as the distance between the permanent magnet 11 on the one hand and the permanent magnets 21, 22 on the other hand is not reduced below the critical value DKR (see FIG. 1*d*). Once the distance between the magnet 11 and magnets 21, 22 is reduced below DKR, the playing piece 12 is "trapped" in between the magnets 21, 22 and remains in such position unless forcibly expelled from the aforementioned gap.

In order to add interest to the game, a player can monitor the length of the interval which is required to "trap" the playing piece 12 between the permanent magnets 21, 22. In other words, the game of FIGS. 2*a*–2*e* can demand a considerable amount of skill, especially if the playing piece 12 is a lightweight piece which is likely to "flee" in front of the approaching permanent magnets 21, 22. It is also possible to select the dimensions of the permanent magnets 21, 22 on the one hand and the dimensions of the playing piece 12 on the other hand in such a way that the gap between the permanent magnets 21, 22 can accommodate two or more playing pieces 12. In such a game, a player can test his or her skill by monitoring the interval which is required to confine a selected (maximum) number of playing pieces 12 in the gap between the permanent magnets 21, 22.

All in all, the game which is shown in FIGS. 2*a*–2*e* is relatively simple. Therefore, such game can be readily played by small children who are not likely to lose interest because of the excessive complexity of the game. Other more complex versions of the improved magnetic game which are similar or analogous to the game of FIGS. 2*a*–2*e* are shown in FIGS. 16–20.

Figure 3:
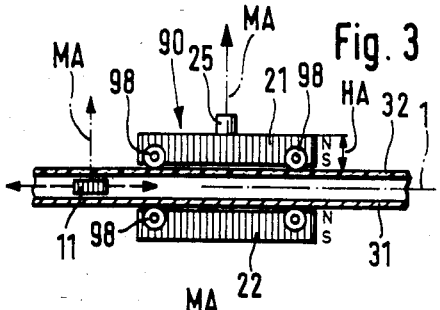
FIG. 3 is a fragmentary sectional view of a game with two wheel-mounted shifting members.

The dimensions of the field 1 which is shown in FIG. 2*a* are limited by the space which is available for one or two attachments including discrete guide rails 41 and the associated pairs of arms 23, 24. This is attributable to the provision of a mechanical connection 28 between the arms 23, 24 for each pair of associated shifting members. FIG. 3 illustrates a portion of a modified game wherein the pairs of arms 23, 24, the connections 28 and the guide rails 41 of FIGS. 2*a*–2*e* can be dispensed with. In this embodiment of the improved magnetic game, the permanent magnets 21, 22 (forming part of an upper and a lower shifting member of the impeller) are coupled to each other exclusively by magnetic forces. The preferably disc-shaped or cylindrical permanent magnets 21, 22 are provided with rotary elements 98 in the form of wheels which engage the respective walls 32, 31 at the opposite sides of the playing field 1 and reduce friction between the shifting members and the walls so that the composite impeller including the permanent magnets 21, 22 can be moved in certain directions in response to exertion of a relatively small force which is applied to the handle 25 extending upwardly from the central portion of the upper permanent magnet 21. The magnets 21, 22 have a common polar axis MA, and each of these magnets can be provided with four wheels 98. As will be explained with reference to FIGS. *9a–9c*, the wheels 98 can be replaced with casters 50 which ensure that friction between the permanent magnets 21, 22 and the outer sides of the respective walls 32, 31 is negligible irrespective of the direction of advancement of the magnets 21, 22 above and below the playing field 1. The reference character 11 denotes the permanent magnet of the playing piece, such as the mouse 12 of FIGS. *2a–2e*, which is movable in any desired direction and can be trapped between the permanent magnets 21, 22 in a manner as described above in connection with FIGS. *1c–1e*. The height or axial length HA of the shifting member 90 including the permanent magnet 21 or 22 can be increased beyond that which is shown in FIG. 3 without departing from the spirit of the invention. The upper permanent magnet 21 attracts the lower permanent magnet 22 and vice versa so that the right-hand polar axis MA of FIG. 3 is common or substantially common to both permanent magnets 21, 22 in spite of the absence of a positive mechanical connection between the shifting members 90. The magnetic forces acting between the magnets 21, 22 of FIG. 3 tend to reduce the height of the playing area 1 between the walls 31 and 32. Therefore, the height of the playing piece including the permanent magnet 11 should be selected with a view to account for some flexing of the top wall 32 toward the bottom wall 31 and/or vice versa. It is also advisable to utilize walls which consist of rigid material to reduce their tendency to flex toward each other and to eventually clamp the playing piece including the permanent magnet 11. Another possibility of reducing the tendency of the walls 32, 31 to flex in directions to reduce the height of the playing area 1 is to reduce the size of the playing board.

Figure 4:
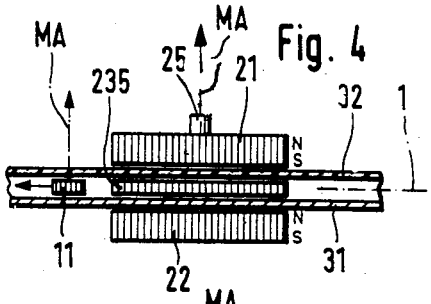
FIG. 4 is a similar fragmentary sectional view of a further magnetic game with three shifting members one of which is disposed between the other two in the space between the two walls of the playing board.

FIG. 4 shows a portion of a magnetic game whose impeller includes two disc-shaped or cylindrical permanent magnets 21 and 22 which are respectively adjacent to the outer sides of the walls 32, 31 and a disc-shaped intermediate magnet 235 whose polar axis MA coincides with those of the magnets 21, 22. The effect of the composite impeller including the permanent magnets 21, 22, 235 of FIG. 4 is the same as that of the permanent magnets 21, 22 of FIG. *1a*, i.e., the impeller invariably repels the magnet 11 of the playing piece which is confined in the field 1 between the walls 31 and 32. The polar axis MA of the magnet 11 is parallel to the common polar axis MA of the magnets 21, 22 and 235. The magnets 21, 22, 235 are magnetically coupled to each other and can be moved with reference to the playing board including the walls 31, 32 by way of the handle 25.

FIGS. *5a*, *5b* and *5c* illustrate a portion of a magnetic game employing a modified impeller including two outer permanent magnets 21, 22 and an intermediate permanent magnet 235 which is dimensioned in such a way that the impeller can attract or repel the magnet 11 of a playing piece, depending upon the distance between the magnet 11 on the one hand and the magnets 21, 22, 235 on the other hand.

It is assumed that the magnets 21, 22 are discs or cylinders having a common polar axis MA. The magnet 235 is assumed to constitute a disc or cylinder whose radius is smaller than the radii of the magnets 21, 22. Thus, and since the magnets 21, 22 automatically maintain the magnet 235 in a position in which its polar axis coincides with those of the magnets 21, 22, the magnets 21, 22 and 235 define an annular pocket 250 which surrounds the centrally located magnet 235 and is flanked by the marginal portions of the magnets 21, 22. The depth of the pocket 250 is shown at DM; it matches the difference between the radius of the magnet 235 and the radii of the magnets 21, 22.

In FIG. *5a*, the distance between the magnets 21, 22 and the magnet 11 of the playing piece exceeds the critical distance DKR; therefore, the impeller including the magnets 21, 22, 235 tends to propel the magnet 11 in the direction indicated by the arrow PAB. In FIG. *5b*, the distance between the periphery of the magnet 11 and the peripheries of the magnets 21, 22 matches the critical distance DKR and, therefore, the impeller including the magnets 21, 22, 235 neither attracts nor repels the playing piece which includes the magnet 11. In FIG. *5c*, the magnet 11 is trapped in the pocket 250 because the distance between its peripheral surface and the peripheral surfaces of the magnets 21, 22 is reduced to less than DKR, i.e., the impeller including the magnets 21, 22, 235 attracts (see the arrow PAN) the playing piece and its magnet 11.

The length of the critical distance DKR depends upon the depth DM of the pocket 250. Thus, if the depth DM of the pocket 250 is increased, the critical distance DKR also increases and the catching of the magnet 11 (i.e., introduction of the magnet 11 into the pocket 250) is simplified. If the depth DM is increased to match the radius of the magnet 21 or 22 (i.e., the magnet 235 is removed or its diameter reduced to a negligible value), the game of FIGS. *5a–5c* is converted into the game of FIGS. *1c–1e*. If the depth DM of the pocket 250 is small, it takes more skill or luck to trap the magnet 11 of the playing piece in the pocket 250. If the depth DM of the pocket 250 is reduced to zero, i.e., if the diameter of the magnet 235 matches those of the magnets 21 and 22, the game of FIGS. *5a–5c* is converted into the aforediscussed game of FIG. 4.

Figure 5A:
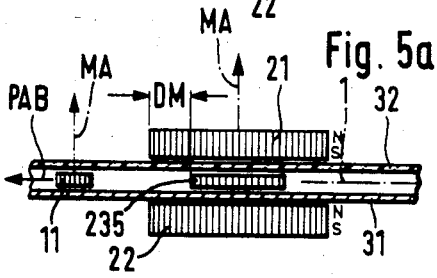
FIG. 5*a* is a fragmentary sectional view of a further game with three shifting members in positions they assume when the playing piece is being repelled thereby.
Figure 6:
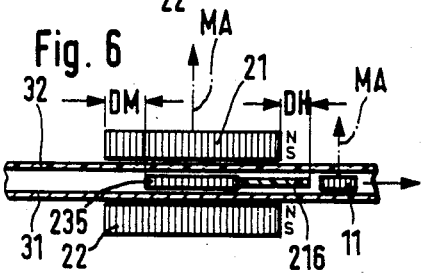
FIG. 6 is a fragmentary sectional view of a magnetic game which constitutes a modification of the game shown in FIGS. 5*a*–5*c*, the third shifting member having a nonmagnetic tail portion which prevents capture of the playing piece except when the latter is caused or allowed to enter a pocket between certain portions of the shifting members.
Figure 7:
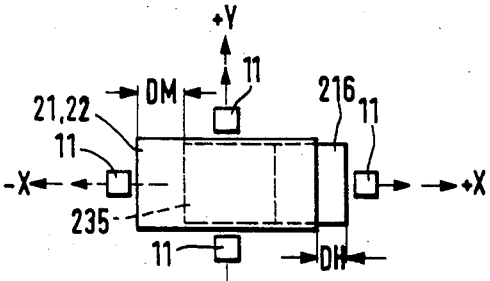
FIG. 7 is a plan view of the structure which is shown in FIG. 6.

Referring to FIGS. 6 and 7, there is shown a magnetic game wherein the impeller comprises a rectangular upper permanent magnet 21, a rectangular lower permanent magnet 22, a substantially square or slightly rectangular intermediate or third permanent magnet 235 and a nonmagnetic tail portion 216 which is attached to the permanent magnet 235 and thus constitutes a component part of the corresponding (third) shifting member of the composite impeller. The permanent magnets 21, 22, 235 of FIGS. 6 and 7 have a common polar axis MA and the width of the three magnets 21, 22, 235 of the impeller which is shown in FIGS. 6 and 7 is at least substantially the same. The pocket 250 is defined by the left-hand marginal portions of the permanent magnets 21, 22 which extend beyond the respective flat side or edge face of the permanent magnet 235. The pocket at the other (right-hand) side of the permanent magnet 235 is substantially filled by the tail portion 216 which extends from the impeller including the permanent magnets 21, 22, 235 through a distance DH, namely, a distance which suffices to prevent the permanent magnets 21, 22 from attracting the permanent magnet 11 in a direction counter to that indicated by the arrow +X. If the magnet 11 is placed adjacent to the one or the other longer side of the impeller of FIGS. 6 and 7, such magnet 11 is repelled in the direction of the arrow +Y or −Y because the width of the magnet 235 equals or approximates the corresponding dimensions of the magnets 21, 22. In other words, a magnet 11 can be attracted into the space between the magnets 21, 22 only if it is adjacent to the left-hand side of the impeller of FIGS. 6 and 7 so that it can enter the pocket 250 between the nearest marginal portions of the magnets 21, 22 which overlie the corresponding marginal portion of and extend beyond the magnet 235 through the distance DM. By utilizing the impeller of FIGS. 6 and 7, a player finds it much more difficult to catch or trap a playing piece including the permanent magnet 11 than by resorting to the game of FIGS. 5*a*–5*c* wherein the pocket extends all the way around the centrally located permanent magnet 235. The facility with which the impeller of FIGS. 6–7 can catch or trap a playing piece including a permanent magnet 11 can be altered by changing the extent DM to which the permanent magnets 21, 22 extend beyond the magnet 235 in the direction indicated by the coordinate −X. The distance DH exceeds or at least equals the aforediscussed critical distance (DKR in FIG. 5*b*) so that the tail portion 216 of the intermediate shifting member of the impeller of FIGS. 6–7 positively prevents attraction of a playing piece to the respective side of the magnet 235, namely into the space between the right-hand portions of the magnets 21, 22, as viewed in FIG. 6 or 7.

The game of FIGS. 6 and 7 can be modified in a number of ways. For example, the width of the permanent magnet 235 can be reduced as considered in the direction of the coordinate +Y or −Y if such side or sides of the magnet 235 are connected with additional tail portions (see FIG. 32) consisting of nonmagnetic material and ensuring that the magnet 11 of a playing piece cannot approach the corresponding side or sides of the larger magnets 21, 22 to less than the critical distance which would permit the magnet 11 to adhere to or to be confined between the adjacent marginal portions of the magnets 21, 22. It is further clear that the permanent magnets 21, 22 and/or 235 of FIGS. 6 and 7 can be provided with wheels or other rotary or rolling elements in order to reduce friction during shifting of such magnets with reference to the adjacent walls 31, 32.

Figure 8:
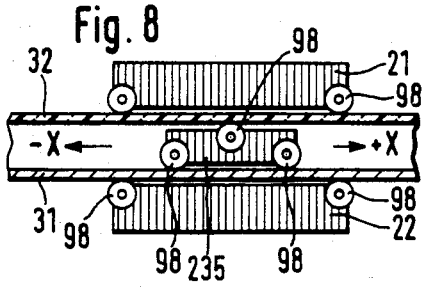
FIG. 8 is a fragmentary sectional view of a magnetic game which is similar to that of FIGS. 5*a*–5*c* except that it employs three wheel-mounted shifting members.

The game which is shown in FIG. 8 is similar to that of FIGS. 5*a*–5*c* or 6–7. The only difference is that the outer permanent magnets 21, 22 are provided with wheels 98 or analogous rolling or rotary elements 98 serving to engage the outer sides of the adjacent plate-like walls 32, 31. Furthermore, the intermediate (smaller-diameter) permanent magnet 235 has a set of wheels 98 which roll along the upper side of the bottom wall 31 and one or more additional wheels 98 which engage the underside of the top wall 32. This reduces the likelihood of flexing of the wall 31 toward the wall 32 and/or vice versa.

Figure 9C:
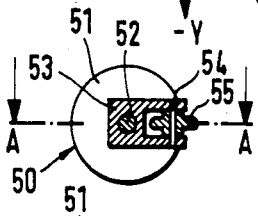
FIG 9*c* is a horizontal sectional view as seen in the direction of arrows from the line B—B of FIG. 9*b;*
Figure 9B:
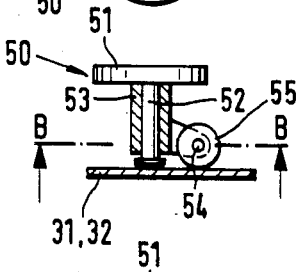
FIG. 9*b* is a sectional view of one of the walls and further shows the rotary element of FIG. 9*a* in partial central vertical sectional view, the section being taken in the direction of arrows as seen from the line A—A in FIG 9*c;*
Figure 9A:
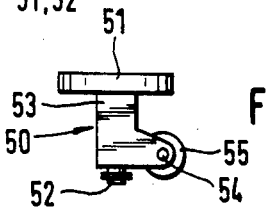
FIG. 9*a* is a side elevational view of a caster-like rotary element which can be used in the magnetic game of the invention.

As mentioned above, the rotary elements 98 which are shown in FIG. 8 are wheels rotatable about axes extending at right angles to the plane of FIG. 8. Such wheels are capable of greatly reducing friction between the magnets 21, 235, 22 and the respective sides of the walls 32, 31 when the composite impeller including these magnets is moved in the direction of the arrow +X or −X. If it is desired to further reduce friction between the impeller and the walls 31, 32, at least one permanent magnet but preferably all permanent magnets of the impeller can be held out of contact with the adjacent surfaces of the respective walls by rotary elements in the form of casters 50 one of which is shown in detail in FIGS. 9*a*–9*c*. The illustrated caster 50 is a conventional device which includes a plate-like holder 51 connectable to the corresponding shifting member of the impeller, a sleeve-like bearing member 53 which is adjacent to and extends from one side of the holder 51 to surround a shaft 52 which is anchored in the holder 51, a bifurcated carrier 54*a* which extends radially from the sleeve 53 at a locus which is remote from the holder 51, a transverse shaft 54 between the prongs of the bifurcated member, and a wheel 55 on the shaft 54 between the prongs of the carrier 54*a*. The sleeve 53 can turn about the axis of the shaft 52, and the wheel 55 can rotate about the axis of the transverse shaft 54 so that the caster 50 reduces friction irrespective of the direction of travel of the respective shifting member with reference to the wall 31 or 32. The axis of the shaft 52 is normal or substantially normal to the walls 31, 32 and the axis of the shaft 54 is parallel to such walls. If it is desired to further reduce the friction between the shifting members of the impeller and the walls 31 and 32, the rotary parts of the caster 50 can be mounted on suitable ball, needle or other antifriction bearings, not shown.

Figure 10:
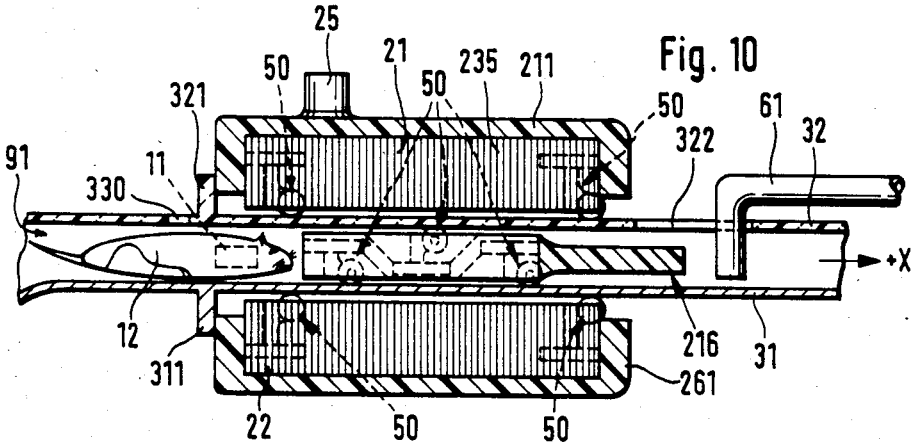
FIG. 10 is an enlarged fragmentary sectional view of a magnetic game which is similar to that of FIG. 6 and further showing a portion of a tool which can be used to expel a captured playing piece in the form of a mouse, the section being taken in the direction of arrows as seen from the line F—F of FIG. 11.
Figure 11:
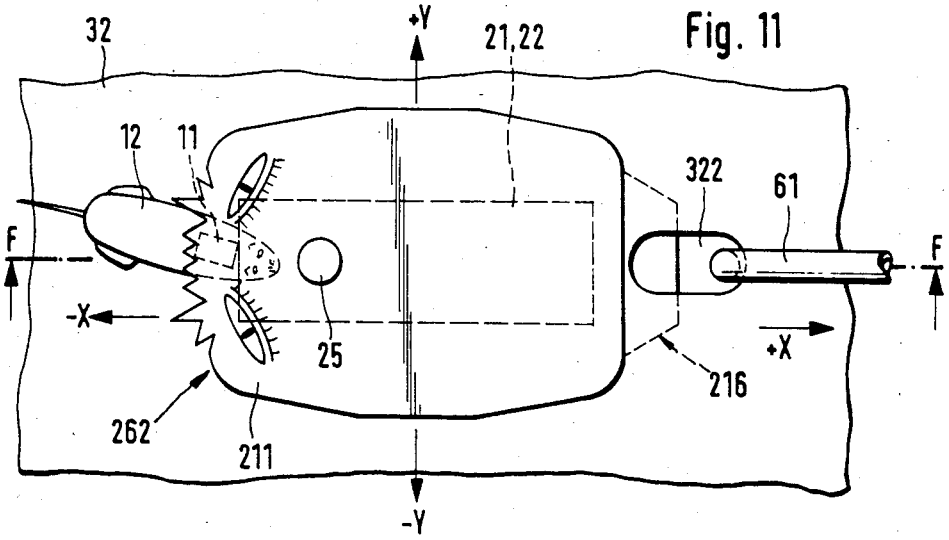
FIG. 11 is a plan view of the structure shown in FIG. 10, with the walls of the playing board omitted.

The manner in which several casters 50 can be partially confined in or otherwise secured to the shifting members of a composite impeller is illustrated in FIGS. 10 and 11. Each of the two larger permanent magnets 21, 22 is embedded in a preferably plastic housing or cage 211, 261 of the corresponding shifting member. The housing 211 for the magnet 21 has an upwardly extending handle 25 which is grasped to move the impeller with reference to the playing field 1 between the walls 31, 32. The magnets 21, 22 can be embedded in the corresponding housings or cages 211, 261 during molding of such housings in a suitable extruding or like machine of any conventional design. The magnets 21, 22 of FIGS. 10 and 11 are elongated rectangles and each thereof is held out of contact with the outer side of the respective wall 32, 31 by four casters 50 disposed at the corners of the respective housings 211, 261. Such mounting of the two outer shifting members on groups of four casters 50 each greatly reduces friction during movement of the composite impeller with reference to the playing field 1. The centrally located shifting member which includes the smaller permanent magnet 235 can constitute or include a synthetic plastic body into which the permanent magnet 235 is embedded and which defines the tail portion 216 extending beyond the corresponding sides of the outer shifting members (housing 211, 261) through a distance as explained above with reference to FIGS. 6 and 7. The magnet 235 is also a rectangle the width of which equals or approximates the width of the magnets 21, 22, as considered at right angles to the plane of FIG. 10. The playing piece 12 resembles a mouse and its head or front portion surrounds the permanent magnet 11. The pocket 250 between the left-hand portions of the permanent magnets 21, 22 is dimensioned to confine the head portion of the playing piece 12. The remainder (rear portion) of the playing piece 12 shown in FIG. 10 extends into an elongated outlet 91 which is defined by the playing board 312 and establishes communication between the playing field 1 and the surrounding region. In order to expel the playing piece 12 from the pocket 250 between the magnets 21, 235, 22 of the composite impeller, it is necessary to move the housings 211, 261 against the corresponding fences 321, 311 so that the rear portion of the playing piece 12 extends into the outlet 91. The player then inserts the tip of a hook-shaped expelling tool 61 into an elongated slot 322 in the top wall 32 and shifts the tip or tooth 61*a* in a direction toward and against the tail portion 216 of the intermediate shifting member including the permanent magnet 235. This causes the intermediate shifting member to travel relative to the walls 32, 31 and relative to the arrested outer shifting members and to thereby push the head portion of the playing piece 12 out of the pocket 250. Once its head portion has been expelled from the pocket 250, the entire playing piece 12 is abruptly expelled into and through the outlet 91 which is preferably elongated and extends in line with the longitudinal direction of the slot 322 in the top wall 32. If the playing field 1 is circular or substantially circular, the outlet 91 can extend radially of such field, and the slot 322 also extends radially of the field and is aligned with the outlet 91.

The intermediate shifting member can be provided with a total of six casters 50, namely, a pair of casters adjacent to the left-hand side of the permanent magnet 235 and in contact with the inner side of the bottom wall 31, a pair of casters adjacent to the tail portion 216 and also in contact with the inner side of the bottom wall 31, and a pair of casters extending upwardly from the central portion of the magnet 235 and contacting the underside of the top wall 32. The length of the slot 322 in the top wall 32 depends on the depth of the pocket 250 between the permanent magnets 21, 22 and the adjacent side or flat of the magnet 235. The shifting members including the housings 211, 261 can be mirror images of each other with reference to a plane which is normal to the plane of FIG. 10 and extends midway between the walls 32, 31.

FIG. 11 shows that the left-hand portion 262 of the housing 211 of the upper shifting member of the composite impeller can be configurated to resemble the head of a cat in order to enhance the appearance of the game and render it more interesting to children.

As discussed in connection with FIGS. 6 and 7, the impeller of FIGS. 10–11 is designed to permit penetration of the head portion of the playing piece 12 only in one direction, namely, into the pocket 250 between the left-hand portions of the permanent magnets 21, 22. In other words, if the playing piece 12 is stationary, the impeller must approach it in the direction of the arrow −X in order to cause the head portion and the magnet 11 to enter the pocket 250. If the playing piece 12 is approached by the impeller in the direction indicated by the arrow +X, +Y or −Y, the playing piece is repelled by, rather than attracted to, the impeller.

The wall bounding the upper side of the outlet 91, as viewed in FIG. 10, has an opening 330 which can serve to permit observation of the playing piece 12 or as a means for affording access to the outlet 91 with the working end of a suitable tool which can be employed to retract the head portion of the playing piece 12 from the pocket 250 between the adjacent portions of the magnets 21, 22. Alternatively, or in addition thereto, the opening 330 can be used for insertion of a portion of a gate 325 (FIG. 27*c*) which normally seals or closes the outlet 91 to prevent unintentional or accidental expulsion of a playing piece 12 from the field 1.

In each embodiment of the improved game, each magnet of the impeller, namely, each magnet of a shifting member, can be assembled of two or more discrete permanent magnets. Such plural permanent magnets can be embedded in a housing consisting of suitable synthetic plastic or other material.

Figure 12:
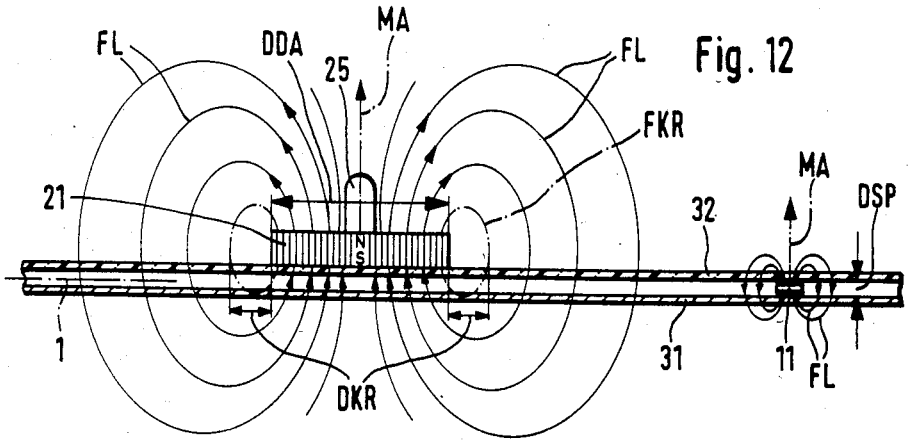
FIG. 12 is a fragmentary schematic sectional view of a magnetic game wherein the impeller comprises a single shifting member.

FIG. 12 illustrates a portion of a further magnetic game wherein the impeller comprises a single shifting member which, in this embodiment, is disposed at a level above the light-transmitting top wall 32 of the playing board. The permanent magnet 21 of the single shifting member can be moved along the outer side of the wall 32 by a handle 25. The left-hand character MA indicates the polar axis, and the middle and left-hand characters FL denote the progress of flux lines of the single permanent magnet 21. The critical distance from the periphery of the magnet 21 to the periphery of the permanent magnet 11 of a playing piece is indicated at DKR. It will be noted that the progress of flux lines FL is analogous to that shown in FIG. 1*a*, namely, the outer flux lines FL progress from the upper side of the magnet 21 toward its underside and the flux lines which approach the underside of the magnet 21 travel upwardly across the playing field 1 between the walls 31, 32 so that this magnet can attract the magnet 11 as soon as the latter is moved beyond the critical distance DKR. The magnet 11 is repelled when it is located outside of the distance shown at DKR. The phantom lines FKR denote the imaginary border surrounding the magnet 21 and determining the critical distance DKR.

It has been found that the effect of the single magnet 21 is somewhat less satisfactory than the effect of two or more permanent magnets such as those shown in FIGS. 1*a*–1*e*, FIG. 3 and FIGS. 10–11. Also, if a single permanent magnet 21 is used, it is desirable that its diameter DDA appreciably exceed the height DSP of the playing field 1 between the inner sides of the walls 31, 32. The polar axis MA of the magnet 21 is parallel to the polar axis MA of the magnet 11, i.e., each of these axes extends at right angles to the walls 31, 32.

Figure 13:
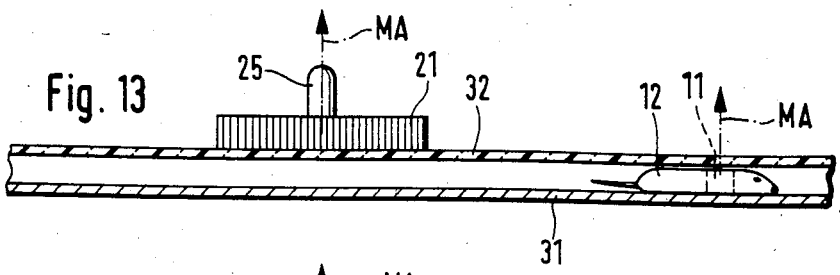
FIG. 13 is a fragmentary sectional view of a game which is similar to that shown in FIG. 12, with a mouse-like playing piece in the space between the walls of the playing board.

FIG. 13 illustrates a portion of a magnetic game which is similar to the game of FIG. 12. The only difference is that the small permanent magnet 11 between the walls 31, 32 is embodied in a playing piece 12 which resembles a mouse. The permanent magnet 11 is installed in the front or head portion of the playing piece 12 so that the head of the "mouse" faces away from the permanent magnet 21 of the impeller when the latter is moved in a direction to the right, as viewed in FIG. 13. The playing piece 12 is repelled when the distance between its magnet 11 and the magnet 21 exceeds the distance DKR shown in FIG. 12 but the playing piece is attracted to and is disposed below the magnet 21 when such distance is reduced below the value DKR.

Figure 14:
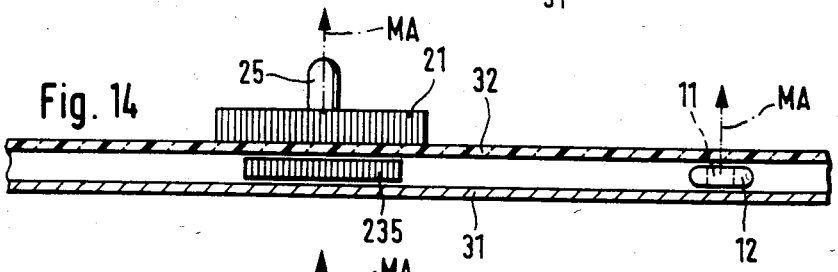
FIG. 14 is a similar fragmentary sectional view of a further magnetic game employing a modified impeller with a first shifting member outwardly adjacent to the top wall and a second shifting member in the space between the two walls.

FIG. 14 illustrates a magnetic game which is similar to that of FIG. 13 except that the impeller comprises a larger permanent magnet 21 at a level above the transparent or translucent top wall 32 and a smaller-diameter permanent magnet 235 in the playing field between the walls 31, 32. The magnets 21, 235 of FIG. 14 have a common polar axis MA which is perpendicular to the walls 31, 32, the same as the axis MA of the magnet 11 in a modified playing piece 12. This playing piece resembles the playing piece 12 of FIGS. 26*a* and 26*b* except that the diameter of its magnet 11 is less than that of the magnet shown in FIG. 26*b*. The playing piece 12 resembles a flattened soccer ball which is repelled by the impeller including the magnets 21, 235 of FIG. 14 when the distance between the magnets 11, 21 exceeds the aforediscussed critical distance but is attracted into the pocket surrounding the smaller-diameter permanent magnet 235 of the impeller when the magnet 11 is moved or is located closer to the magnet 21. The magnets 21, 235 of FIG. 14 are magnetically coupled to each other. It has been found that such magnetic coupling suffices to ensure that the axis MA of the magnet 21 coincides with the axis MA of the magnet 235. The mode of operation of the structure which is shown in FIG. 14 is analogous to that of the structure which is shown in FIGS. 5*a*–5*c*.

Figure 15:
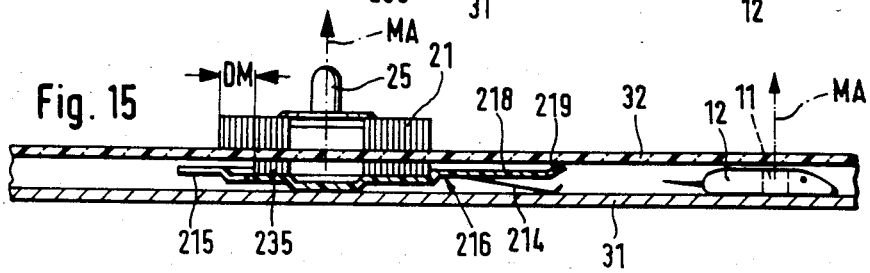
FIG. 15 is a fragmentary sectional view of a game which is similar to that of FIG. 14 except that it employs a different shifting member in the space between the two walls.

FIG. 15 illustrates a portion of a further magnetic game wherein the playing piece 12 is identical with the playing piece of FIG. 13 and the impeller including the permanent magnets 21, 235 is somewhat similar to the impeller of FIG. 14. The outer magnet 21 is assumed to have an elongated rectangular shape and the magnet 235 is a shorter rectangle having a polar axis MA which coincides with the polar axis of the magnet 21. The reference character DM denotes the depth of the pocket 250 below the left-hand marginal portion of the magnet 21. Such pocket can accommodate a portion of the playing piece 12, preferably the head portion or front portion which is nearer to the permanent magnet 11. The exact construction of the entire shifting member including the permanent magnet 235 of FIG. 15 is shown in greater detail in FIGS. 16 and 17. The only difference between the impeller of FIG. 15 and the impeller of FIGS. 16 and 17 is that the impeller of FIGS. 16–17 further includes a second outer shifting member (including the permanent magnet 22) which is adjacent to the underside of the bottom wall 31.

An important advantage of the game which is shown in FIG. 15 is that a playing piece 12 which is trapped below the left-hand portion of the permanent magnet 21 can be released and expelled from the permanent magnet 235 by the simple expedient of lifting the magnet 21 in the direction of its polar axis MA, namely, upwardly and away from the upper side of the light-transmitting top wall 32. This enables the magnet 235 to immediately repel the magnet 11 so that the entire playing piece 12 is moved beyond the critical distance from the impeller.

Figure 5B:
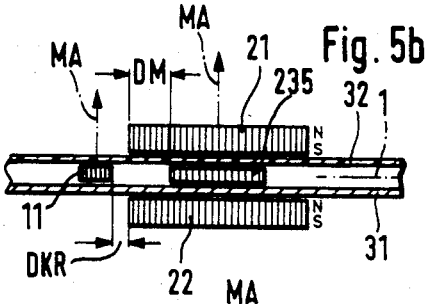
FIG. 5*b* illustrates the structure of FIG. 5*a* but with the shifting members nearer to the playing piece.
Figure 5C:
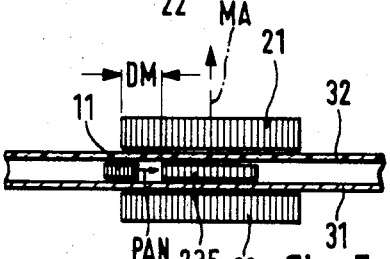
FIG. 5*c* illustrates the structure of FIG. 5*a* or 5*b* but with the playing piece captured in a pocket which is defined by the shifting members.

It will be noted that the mode of operation of an impeller which includes a single magnet (FIG. 13) or two magnets (FIGS. 14 and 15) need not be appreciably different from the mode of operation of an impeller with three distinct shifting members each of which has at least one permanent magnet (see, for example, FIGS. 5*a*–5*c*). The configuration and construction of a playing board which can utilize the impeller of FIG. 13, the impeller of FIG. 14 or the impeller of FIG. 15 will be described with reference to FIGS. 27*a*–27*d*. It is clear that each of the magnets 21, 235 shown in FIGS. 13–15 can be provided with one or more pairs of wheels or casters in order to reduce friction between the corresponding shifting member or members on the one hand and the adjacent wall or walls of the playing board on the other hand.

Figure 16:
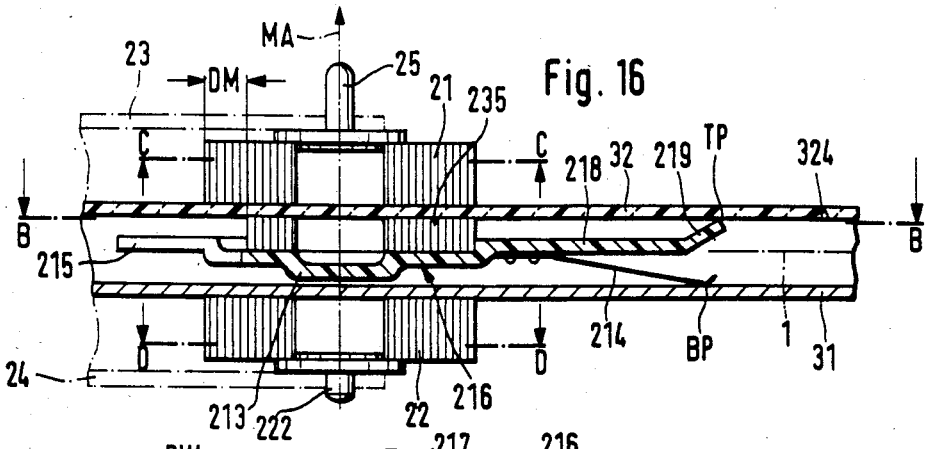
FIG. 16 is an enlarged view of a portion of the game which is shown in FIG. 15 and further shows a shifting member adjacent to the underside of the bottom wall, the section being taken in the direction of arrows as seen from the line A—A of FIG. 17.
Figure 17:
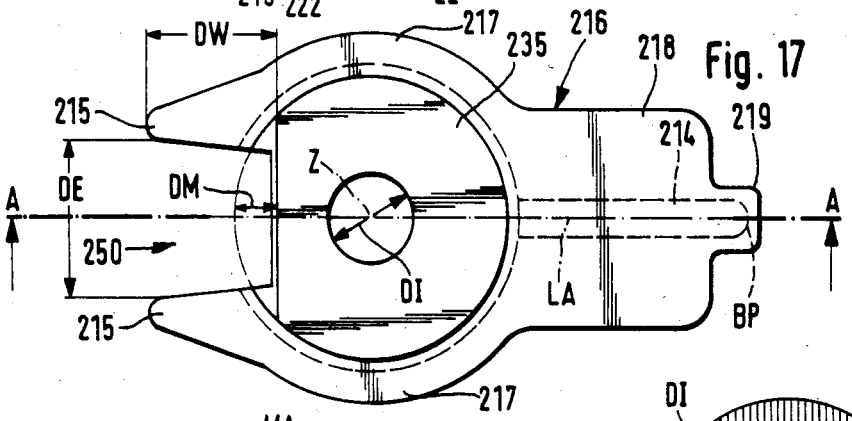
FIG. 17 is a plan view of the third shifting member as seen in the direction of arrows from the line B—B of FIG. 16.
Figure 18:
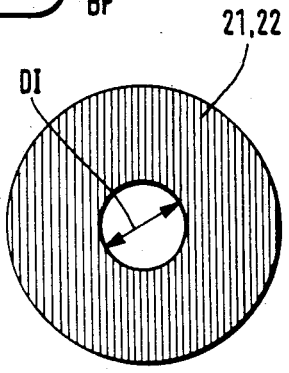
FIG. 18 is a sectional view of the upper shifting member of FIG. 16 as seen in the direction of arrows from the line C—C or D—D.

The magnetic game of FIGS. 16 to 18 employs an impeller with three ring-shaped permanent magnets 21, 22, 235 each of which has an inner diameter DI (see FIG. 18). In other words, each of the permanent magnets 21, 22, 235 resembles a rather thin washer, and such permanent magnets have a common polar axis MA. The left-hand side of the periphery of the centrally located permanent magnet 235 has a flat 235*f* so that this permanent magnet defines with the adjacent portions of the magnets 21, 22 a pocket 250 having a depth DM. Such pocket renders it possible to catch the head portion of a playing piece, for example, a replica of a mouse of the type shown in FIG. 13 or 15. The permanent magnets 21, 235, 22 of FIGS. 16–18 can be magnetically coupled to each other. In addition, the magnets 21, 22 (and more particularly the corresponding shifting members of the impeller) can be mechanically coupled to each other in a manner as described in connection with FIGS. 2*a*–2*e*. FIG. 16 merely shows by broken lines portions of the two arms 23, 24 of the mechanical connection between such outer shifting members. The mechanical connection between the two outer shifting members including the magnets 21, 22 is optional.

An advantage of annular permanent magnets in the shifting members of the impeller is that such magnets are more likely to remain coaxial with one another, even in the absence of any mechanical connection between the two outer shifting members. Another advantage of such construction is that the centrally located permanent magnet 235 (which is magnetically coupled to the magnets 21, 22) can be turned about its axis Z which coincides with the polar axis MA of the magnets 21, 22. Such angular displacement of the centrally located permanent magnet 235 does not adversely influence the flow of magnetic forces. The intermediate shifting member which includes the permanent magnet 235 of FIGS. 16 and 17 further comprises a nonmagnetic component 218 which is preferably permanently connected with the magnet 235. The component 218 can be made of a plastic material and has a tail portion 216 extending away from the impeller in a direction diametrically opposite the pocket 250 (see particularly FIG. 17). The configuration of the synthetic plastic portion 218 of the intermediate shifting member is such that it renders it more difficult to trap a portion of a playing piece in the pocket 250. Such pocket is flanked by two jaws 215 which constitute extensions of arcuate portions 217 connected to the tail portion 216 of the plastic component 218. Since the jaws 215 flank the pocket 250, the latter is not as readily accessible as if the sides of the pocket were open. As mentioned above, the depth of the pocket 250 itself (namely, of the space between the left-hand marginal portions of the magnets 21, 22 extending beyond the flat 235) is shown at DM. However, the jaws 215 increase the effective depth of the pocket 250 from DM to DW, namely, to the distance between the tips of the jaws 215 and the flat 235F. The maximum width of the pocket 250 is shown at DE. The arcuate portions 217 of the plastic component 218 of the intermediate shifting member extend radially beyond the peripheral surfaces of the magnets 21, 22 to such an extent that they prevent the magnets 21, 22 from attracting the magnet 11 of a playing piece. The same holds true for the tail portion 216 which can extend well beyond such distance. The outermost part of the tail portion 216 has an upwardly extending lug 219 which abuts against the inner side of the light-transmitting wall 32. The tail portion 216 is biased against the wall 32 by a leaf spring 214 which is riveted or otherwise secured to the tail portion 216 close to the permanent magnet 235 and extends downwardly toward and into contact with the upper side of the bottom wall 31. The bent-over free end portion of the leaf spring 214 is shown at BP. Such rounding or bending of the end portion of the spring 214 reduces friction between the spring and the bottom wall 31. The purpose of the spring 214 is to urge the lug 219 upwardly with a force to ensure that the tip JP of such lug can enter a recess or notch 324 provided in the inner side of the top wall 32. When the player causes the lug 219 to enter the suitably inclined recess 324, the permanent magnets 21, 22 can be shifted relative to the permanent magnet 235 in a direction to the right, as viewed in FIG. 16, in order to expel a trapped playing piece 12 from the pocket 250.

The spring 214 ensures the establishment and maintenance of permanent frictional engagement between the lug 219 and the top wall 32. This ensures that the pocket 250 is located at the front end of the intermediate shifting member when the impeller of FIG. 16 is moved in a direction to the left, namely, in the direction of the central longitudinal axis LA of the intermediate shifting member. Such axis is automatically aligned with the direction of movement of the impeller to the left, as viewed in FIG. 16 or 17, in view of the fact that the spring 214 biases the tip JP of the lug 219 on the tail portion 216 against the inner side of the top wall 32. The same holds true if the impeller is moved in any other direction, i.e., frictional engagement between the lug 219 and the inner side of the top wall 32 ensures that the tail portion 216 is invariably located rearwardly of the magnets 21, 235, 22 when the impeller is moved in any desired direction. This, in turn, ensures that the pocket 250 faces forwardly so as to render it more likely that a skillful player can catch the front portion of the playing piece 12.

FIG. 16 shows that the permanent magnet 235 is nearer to the underside of the permanent magnet 21 than to the upper side of the permanent magnet 22. The plastic component 218 has a raised intermediate portion or bump 213 which overlies the lower end of the central opening in the magnet 235 and constitutes a skid which maintains the magnet 235 closer to the magnet 21 than to the magnet 22.

In the embodiment of FIGS. 16–18, the magnets 21, 235, 22 are in sliding frictional engagement with the surfaces of the adjacent walls 32, 31. The extent of frictional engagement can be reduced considerably by resorting to casters 50 of the type shown in FIG. 19. In this embodiment of the impeller, the construction of the intermediate shifting member including the permanent magnet 235 is identical with that of the intermediate shifting member which is shown in FIGS. 16 and 17. The difference is that the casters 50 (of the type shown in FIGS. *9a–9c*) are installed in the central bore of each of the magnets 21, 235, 22. The casters 50 of the magnets 21, 22 respectively engage the upper side of the light-transmitting top wall 32 and the underside of the bottom wall 31. The caster 50 of the permanent magnet 235 engages the underside of the top wall 32 whereas the bump 213 of the plastic component 218 contacts the upper side of the bottom wall 31 (except if the magnet 21 attracts the magnet 235 with such a force that the bump 213 of the plastic component 218 is out of actual contact with the bottom wall 31). It is preferred to equip the casters 50 (for example the casters shown in FIG. 19) with antifriction ball or needle bearings to thus further reduce friction between the shifting members of the impeller and the respective sides of the walls 31 and 32.

Figure 20:
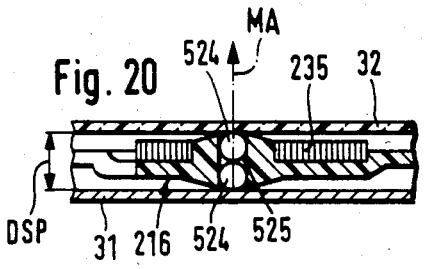
FIG. 20 is a fragmentary sectional view of a magnetic game employing a modified shifting member in the space between the top and bottom walls of the playing board.
Figure 19:
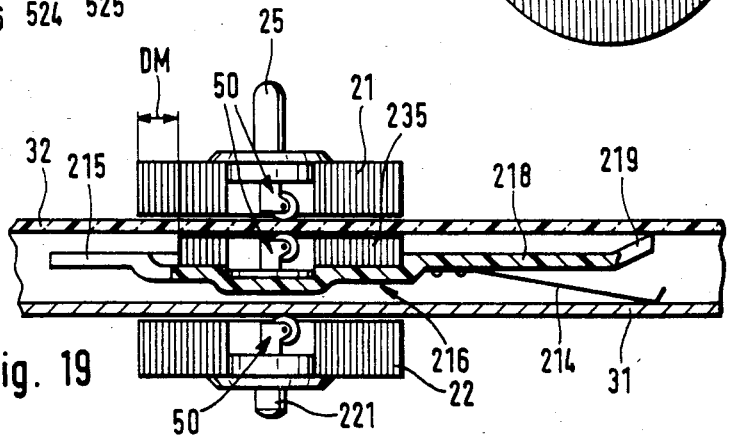
FIG. 19 is a fragmentary sectional view of a magnetic game which constitutes a modification of that shown in FIG. 16.

A further mode of reducing friction between an intermediate shifting member (namely, a shifting member which is disposed between the walls 31, 32 of the playing board) and the top and bottom walls is illustrated in FIG. 20. The material of the plastic component 218 fills the axial bore of the permanent magnet 235 and the core of plastic material within the confines of the magnet 235 has an axial bore 525 having an axis which coincides with the polar axis MA of the magnet 235. The bore 525 contains two spherical rolling elements 524 each having a diameter corresponding to half the distance between the inner sides of the walls 31 and 32. The spherical rolling elements 524 not only reduce friction between the intermediate shifting member and the playing board but they also ensure that the distance DSP between the walls 31, 32 remains unchanged even if the permanent magnet(s) of the outer shifting member(s) of the impeller including the intermediate shifting member of FIG. 20 exhibits or exhibit a pronounced tendency to flex the wall 32 toward the wall 31 and/or vice versa. It is preferred to install the spherical elements 524 with a minimum of play. The game which embodies the structure of FIG. 20 can employ a pair of readily flexible walls 31, 32 without the danger of unduly reducing the distance DSP so that the walls could actually clamp one or more playing pieces in the field 1.

Figure 22:
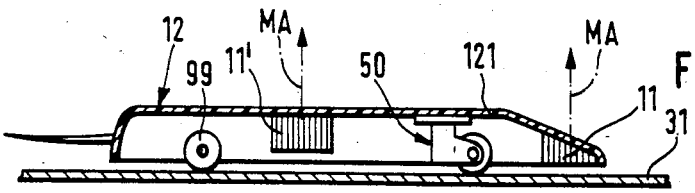
FIG. 22 is a longitudinal vertical sectional view of the playing piece as seen in the direction of arrows from the line A—A of FIG. 21.
Figure 21:
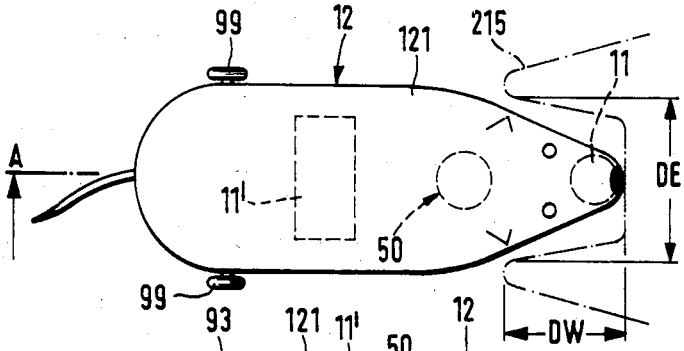
FIG. 21 is an enlarged plan view of a mouse-like playing piece which can be utilized in the magnetic game of the presant invention.

FIGS. 21 and 22 illustrate the details of one of certain presently preferred playing pieces 12. This playing piece comprises a housing or body 121 which may be made of a synthetic plastic material and resembles the body of a mouse. The head or front portion of the body 121 contains the relatively small permanent magnet 11 having a polar axis MA which is parallel to the polar axis of permanent magnet(s) forming part of the impeller and to the polar axis MA of a second or auxiliary permanent magnet 11' installed in the body 121 in or close to the rear portion of the playing piece 12. The body 121 is mounted on a pair of coaxial wheels 99 supporting the rear portion of the body and contacting the upper side of the bottom wall 31, and on a caster 50 which is installed in the body 121 closely behind the front permanent magnet 11 and enables the front portion to change the direction of its movement when the rear portion is approached by the magnet or magnets of an impeller. The jaws 215 of the plastic component 218 shown in FIGS. 16 and 17 are indicated in FIG. 21 by phantom lines. It will be noted that the dimensions (DE and DW) of the pocket 250 between the jaws 215 and the flat 235F are such that this pocket can receive the front portion of the playing piece 12 but is incapable of accommodating the rear portion, namely the portion which is disposed at the left-hand end of FIG. 21 or 22. The purpose of the auxilliary permanent magnet 11' in the body 121 is to promote the repelling action of the impeller when the latter approaches the playing body 12 of FIGS. 21 and 22.

If the playing piece 12 of FIGS. 21 and 22 is utilized in the game of FIGS. 16–18, and the player wishes to trap its front portion in the pocket 250, the impeller of FIG. 16 is manipulated as follows: When the player manipulates the impeller by way of the handle 25 so as to approach the playing piece 12, the impeller repels the playing piece whereby the head portion of the playing piece faces away from the impeller. The width DE of the pocket 250 between the jaws 215 of the component 218 suffices to permit entry of the pointed front portion of the playing piece 12, provided that the player exhibits sufficient skill so as to corner the playing piece 12 in a position such that the pocket 250 can approach and ultimately receive the part including the permanent magnet 11.

Figure 23B:
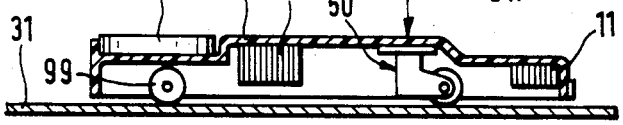
FIG. 23*b* is a sectional view as seen in the direction of arrows from the line A—A of FIG. 23*a;*
Figure 23A:
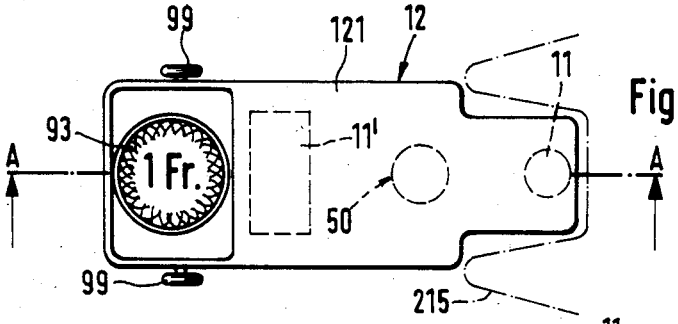
FIG. 23*a* is a plan view of a modified playing piece which can carry one or more coins.

FIGS. 23*a* and 23*b* illustrate a modified playing piece 12 having a body 121 resembling the body of a motor vehicle and containing a front permanent magnet 11 and an auxiliary permanent magnet 11'. The distribution of wheels 99 and caster 50 is analogous to that in the playing piece 12 of FIGS. 21 and 22. A platform of the rear portion of the housing 121 (between the wheels 99) is large enough to accommodate a coin 93. Trapping of the playing piece 12 of FIGS. 23*a* and 23*b* can prove profitable to a skillful player if the rules of the game provide that the coin 93 which is carried by the rear portion of the body 121 belongs to the party first catching the corresponding playing piece.

The manner in which the trapped playing piece 12 can be expelled from the pocket 250 is preferably the same as described in connection with and shown in FIG. 10. However, other modes of segregating an impeller from the trapped playing piece of playing pieces are possible, and one such method will be described with reference to FIGS. 27*a*–27*d* and 28.

Figure 24:
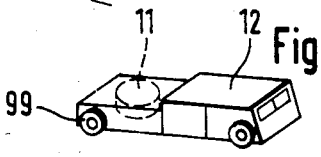
FIG. 24 is a perspective view of a playing piece which resembles a motor vehicle.

FIG. 24 illustrates a modified playing piece 12 which also resembles a motor vehicle. The permanent magnet 11 is installed in the preferably plastic body of the playing piece 12 between and close to the front wheels 99. The vehicle is further provided with a pair of rear wheels which may or may not be identical with the front wheels 99. The front wheels 99 can be replaced with a caster 50 of the type shown in FIGS. 9*a*–9*c*.

Figure 25A:
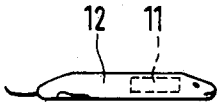
FIG. 25*a* is a side elevational view of a further playing piece which resembles a sheep.
Figure 25B:
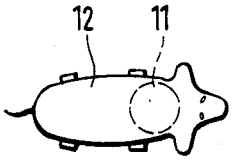
FIG. 25*b* is a plan view of the playing piece which is shown in FIG. 25*a;*

FIGS. 25*a* and 25*b* illustrate another playing piece 12 which has a plastic housing or body resembling a sheep. The permanent magnet 11 is enclosed in or close to the front or head portion of the playing piece 12. This playing piece can be provided with a pair of front wheels 99 and with a pair of rear wheels 99. If desired, the front wheels can be replaced with a caster 50.

Figure 26B:
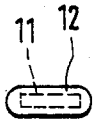
FIG. 26*b* is a side elevational view of the playing piece which is shown in FIG. 26*a;*
Figure 26A:
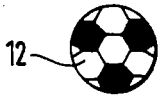
FIG. 26*a* is a plan view of a playing piece which resembles a soccer ball.

FIGS. 26*a* and 26*b* illustrate an additional playing piece 12 which resembles a flattened soccer ball and has a centrally located permanent magnet 11. This playing piece can be used in all or nearly all embodiments of the improved game. Reference may be had to the preceding description of FIG. 14 which shows a playing piece 12 resembling a soccer ball between the walls 31, 32 of the playing board.

As mentioned before, the housings or bodies of the playing pieces preferably consist of a synthetic plastic material, and the permanent magnet 11 or magnets 11, 11' can be permanently embedded in such plastic material during the making of the respective body. The rotary rolling elements are desirable but not absolutely necessary. The need for such rolling elements depends on the dimensions and weight of the playing pieces as well as on the strength of permanent magnet or magnets in the impeller.

Referring now to FIGS. 27*a*–27*d*, there is shown an additional magnetic game which can employ one or more playing pieces 12 of the type shown, for example, in FIGS. 21 and 22. The construction of the playing board 312 is similar or analogous to the construction of the playing board of FIGS. 2*a*–2*e* and identical or analogous parts of the two playing boards are denoted by similar reference characters. The impeller of the game which is shown in FIGS. 27*a*–27*d* is similar to or identical with the impeller of FIGS. 16 and 17. Thus, this impeller comprises two outer permanent magnets 21, 22 and an intermediate permanent magnet 235 forming part of an intermediate shifting member which further includes a plastic component 218 defining a pocket 250. The distance DSP between the inner sides of the walls 31, 32 exceeds the height HSP of the playing piece 12. The polar axis MA of the magnet 11 forming part of the playing piece 12 is parallel to the common polar axis MA of the magnets 21, 235, 22 and is perpendicular to the walls 31, 32. The permanent magnets 21, 22, 235 of the impeller are magnetically coupled to each other, i.e., the moving means including the arms 23, 24 of FIGS. 2*a*–2*d* are omitted. The impeller can be moved relative to the playing board 312 by way of a handle 25 which extends upwardly from the central portion of the uppermost shifting member including the permanent magnet 21. However, in spite of the absence of the arms 23, 24, the playing board 312 of FIG. 27 is preferably provided with sockets 315 for the reception of pins 42 on guide rails 41 (refer to FIGS. 2*a*–2*d*) if the game of FIGS. 27*a*–27*d* is to be played by several participants each of whom prefers to manipulate the corresponding impeller through the medium of a pair of interconnected arms 23, 24 or analogous mechanical moving means.

FIG. 27*a* shows that the playing board 312 has four outlets 91 which extend substantially radially of the substantially circular playing field 1 and are disposed at the four corners of the substantially square boundary 313 forming part of the playing board 312 and confining and surrounding the two walls 31, 32. As can be seen in FIG. 27*c*, the underside of each outlet 91 is bounded by a ramp 317 which slopes outwardly and downwardly, and each outlet can be closed by a pivotable gate 325 the downwardly bent front end portion 326 of which can pass through the corresponding opening 330 in the boundary 313 in order to seal or close the respective outlet 91, namely, to prevent expulsion of a playing piece 12 from the field 1 into a selected outlet 91 unless the player manipulates the handle 327 which is attached to the corresponding gate 325 and pivots such gate to the broken-line position shown in FIG. 27*c*. The pivot for the gate is shown at 328. The opening 330 is provided in an outward extension of the top wall 32, namely in a portion of the top wall 32 which is located externally of the corresponding fence 321. The reference character 329 denotes in FIGS. 27*a*, 27*c*, 27*d* one of the bearing members for the end portions of the corresponding pivot 328. A stop 329*a* can be provided to hold the gate 325 in open or inoperative position. The inner end portions of the elongated outlets 91 terminate at the locating means 101 for the top wall 32, and the end portions 326 of the gates 325 extend substantially tangentially of the field 1 when such end portions are held in the operative positions corresponding to that shown in FIG. 27*c*.

FIG. 27*a* shows that each of the four outlets 91 is flanked by additional permanent magnets 70 whose polar axes MA are perpendicular to the walls 31, 32. The purpose of the additional magnets 70 is to repel the playing pieces 12 which are located in the playing field 1 as well as to promote expulsion of the playing pieces through the respective outlets 91 when the corresponding gates 325 are moved to inoperative positions and a playing piece has penetrated well into the respective outlet. The tendency of the permanent magnets 70 to repel the playing pieces 12 from the marginal portions of the field 1 can be quite pronounced so that, in the absence of any influence by the magnets of an impeller, the playing piece or pieces 12 tend to gather at or close to the center of the playing field.

The major part of the playing board 312 (or the entire playing board) preferably consists of a suitable synthetic plastic material. The top wall 32 can be lifted off its locating means 101, 102 in a manner and for the purposes as described in connection with FIGS. 2*a*–2*e*.

FIG. 27*a* further shows two elongated slots 322 which are parallel with the longitudinal directions of the corresponding outlets 91. As described in connection with FIG. 10, expulsion of a playing piece 12 by way of the two upper outlets 91 shown in FIG. 27*a* necessitates resort to a tool 61 having a downwardly extending working end or tooth 61*a* which can be caused to penetrate through the corresponding slot 322 and into the playing field 1 so as to shift the intermediate shifting member of the impeller with reference to the other two shifting members.

Since the top wall 32 can be readily lifted off the remainder of the playing board 312, an operator can select the nature of the impeller which is to be used in the improved magnetic game. For example, the operator can remove the intermediate shifting member including the permanent magnet 235 and operate only with the permanent magnets 21, 22. Also, the operator can remove the lower permanent magnet 22 and use an impeller which includes only the permanent magnets 21, 235. Such liftability of the top wall 32 also facilitates insertion of additional playing pieces 12 into the field 1, removal of one or more playing pieces from such field and/or insertion into the playing field of one or more inserts of the type shown, for example, in FIGS. 29 and 30.

Figure 28:
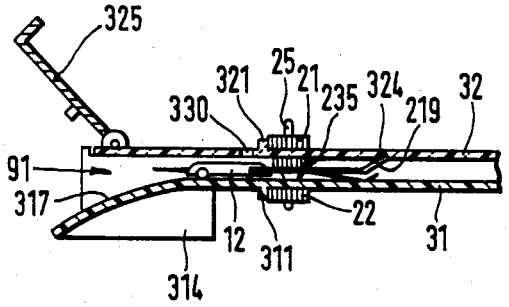
FIG. 28 is a sectional view similar to that of FIG. 27*c* but showing the gate for one of the outlets of the playing board in open position and the impeller in the process of expelling a mouse-like playing piece from the playing field by way of the exposed outlet.

The manner in which a playing piece 12 can be expelled from the playing board 312 of FIGS. 27*a*–27*b* is illustrated in FIG. 28. This Figure shows that the head or front portion of a playing piece 12 which resembles a mouse is trapped in the pocket 250 between the magnets 21, 235, 22 of the impeller having the shape and operating in a manner as described in connection with FIGS. 16 and 17. When the front portion of the playing piece 12 is properly trapped in the pocket 250, the player engages the handle 25 and moves the impeller to the position of FIG. 28 wherein the rear portion of the playing piece 12 extends into the innermost portion of the selected outlet 91. Such movement of the rear portion of the playing piece 12 into the outlet 91 must be preceded by pivoting of the corresponding gate 325 to its inoperative position as actually shown in FIG. 28. The impeller of FIG. 28 is properly positioned when the lug 219 of its tail portion 216 extends into the notch 324 which is machined into the inner side of the top wall 32 and extends substantially transversely of the longitudinal direction of the respective outlet 91. In the next step, the player moves the permanent magnets 21, 22 in a direction to the right, as viewed in FIG. 28, with reference to the permanent magnet 235 which is held against such movement by the lug 219 and the surface surrounding the respective recess 324. This enables the permanent magnet 235 to propel the playing piece 12 deeper into the respective outlet 91 as soon as the pocket 250 disappears as a result of rightward movement of the magnets 21, 22. The extent of propulsion of the playing piece 12 into the outlet 91 is sufficient to ensure that the additional permanent magnets 70 which flank the outlet 91 of FIG. 28 can take over and complete the expulsion of the playing piece 12 along the downwardly and outwardly sloping upper side of the ramp 317.

Figure 29:
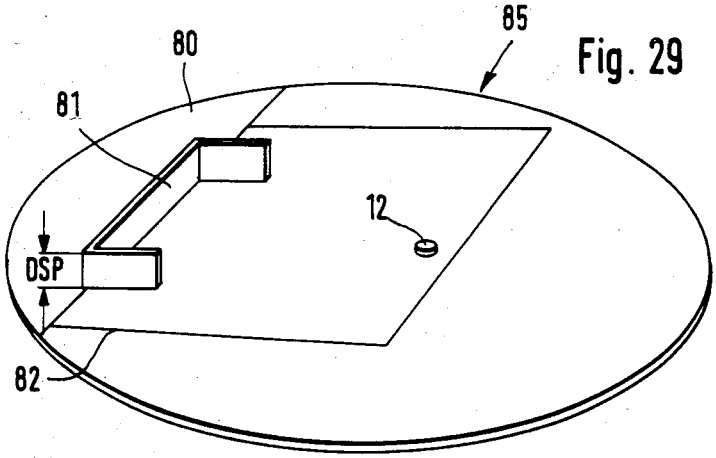
FIG. 29 is a perspective view of an insert which can be used in the magnetic game of the invention to facilitate the "kicking" of a ball-like playing piece into a goal.

Referring to FIG. 29, there is shown an insert 85 which comprises a relatively thin panel, foil or plate 80 the upper side of which is provided with lines 82 denoting a portion of a soccer field. The insert 85 further carries a projection 81 which constitutes or resembles the goal on a soccer field and which has a height DSP equalling or approaching the distance between the top and bottom walls 31, 32 (see FIGS. 31 and 32). The playing piece 12 is a replica or imitation of a soccer ball, for example a playing piece of the type shown in FIGS. 26*a* and 26*b*. Such playing piece can be first positioned at a proper distance in front of the goal 81, namely, at a distance which is required for carrying out a so-called penalty kick. The player then causes the impeller (not shown in FIG. 29) to propel the playing piece 12 toward the goal 81. Two or more players can alternate in order to ascertain who will be first to score a certain number of goals. The insert 85 is a lightweight structure which can be inserted into the playing field 1 on lifting of the top wall 32. The material of the panel 80 can be a metallic foil, a plastic foil or a sheet of paper or cardboard.

Figure 30:
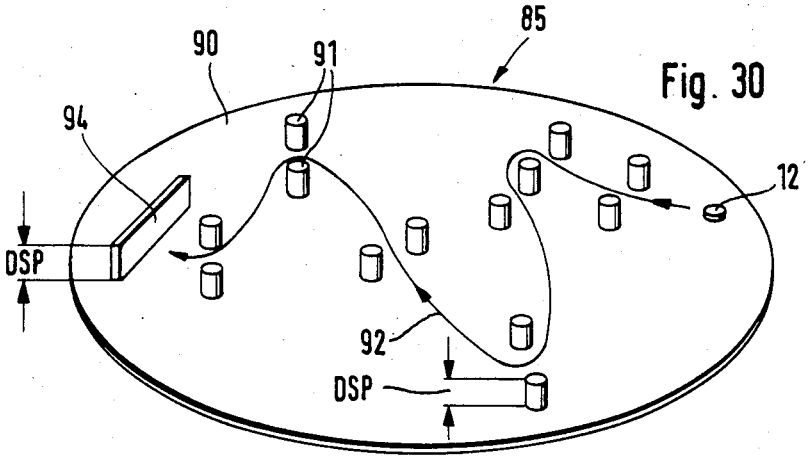
FIG. 30 is a similar perspective view of a modified insert which carries an indicium denoting the proposed path of a playing piece through a series of slalom gates.

The insert 85 of FIG. 30 comprises a circular or oval panel 90 of paper or the like and a plurality of projections 91 which extend from the upper side of the panel 90 and define gates resembling the gates of a slalom field. The playing piece 12 can be placed in front of the first gate and the impeller is thereupon manipulated to advance the playing piece along a predetermined path which is indicated by the meandering line 92 and which is the proposed path leading toward the finish gate 93. The height DSP of the projections 91 and 93 should not exceed the optimum distance between the walls 31, 32 (not shown in FIG. 30). If the gates including pairs of neighboring projections 91 are rather close to each other, the impeller which is to be used with the playing piece 12 of FIG. 30 is preferably devoid of a centrally located or intermediate shifting member (magnet 235).

One mode of utilizing the insert 85 of FIG. 29 (for example, in a game of the type shown in FIGS. 27*a*–27*d*) is shown in FIGS. 31 and 32. The "player" carrying out the penalty kick is represented by the right-hand impeller including three magnets 21, 22, 235 and a handle 25. The "goalie" is represented by the left-hand impeller which also includes three magnets 21, 235, 22, a handle 25 and a plastic component preferably having several outwardly extending tail portions 216. The "goalie" is located between the playing piece 12 (e.g., a soccer ball of the type shown in FIGS. 26*a* and 26*b*) and the goal 81. The impeller carrying out the penalty kick can propel the playing piece 12 mechanically and/or magnetically, and the player manipulating the left-hand impeller attempts to prevent penetration of the playing piece 12 into the goal 81. The "goalie" can attempt to repel the oncoming playing piece 12, to intercept and trap such playing piece, or to simply deflect the oncoming playing piece in a direction away from a path leading into the goal 81. In order to facilitate the task of the "goalie" (left-hand impeller of FIGS. 31 and 32), the intermediate shifting element of this impeller is provided with several tail portions 216 each corresponding to the tail portion 216 shown in FIG. 16. This enables the left-hand impeller to cover a larger area in front of the goal 81. The diameter of the permanent magnet 235 forming part of the right-hand impeller can equal or approximate the diameters of the corresponding permanent magnets 21, 22. On the other hand, the diameter of the left-hand permanent magnet 235 of FIG. 31 is preferably smaller than the diameters of the corresponding permanent magnets 21, 22. If the "goalie" has trapped or snared the oncoming playing piece 12, such playing piece can be separated from the respective impeller by the simple expedient of moving the impeller toward the goal 81 so that the left-hand magnets 21, 22 advance to the left and beyond the goal which latter intercepts the intermediate permanent magnet 235 so that the magnet 235 is free to repel the trapped playing piece 12 in a direction toward the position shown in FIG. 31 or 32. The attacking player is then in a position to try the penalty kick again.

If the insert 85 of FIG. 30 is placed into a field 1, for example into the field of the board 312 shown in FIGS. *27a–27d*, the player manipulating the impeller can play against time to ascertain how long it takes to advance the playing piece 12 from the position which is shown in FIG. 30 into contact with the finish gate represented by the projection 93. Two or more different players can alternate in trying to advance the playing piece 12 along the path which is denoted by the meandering line 92. Skipping of one or more gates can result in assessment of a selected number of penalty points. The rules of the game can be varied at the option of the participant or participants. As mentioned above, the impeller which is used to advance the playing piece 12 of FIG. 30 must be devoid of an intermediate shifting member if the gates which are defined by pairs of projections 91 are sufficiently close to each other to prevent the passage of a permanent magnet 235 therebetween. The omission of intermediate shifting member also contributes to versatility and complexity of the game which can be played by resorting to the insert 85 of FIG. 30 because, if the operator moves the impeller too close to the playing piece 12, such playing piece can be trapped between the permanent magnets 21 and 22 or by the permanent magnet 21 or 22 alone, and this can result in assessment of a selected number of penalty points against the operator of the impeller. The projection 93 denoting the finish gate in the game utilizing the insert 85 of FIG. 30 can constitute a stop for the playing piece 12 so that such playing piece can be separated from the impeller by moving the permanent magnets 21, 22 of such impeller to the left and beyond the projection 93. The permanent magnets 21, 22 are then free to repel the playing piece 12 away from the projection 93, namely, they can be used to return the playing piece to the position which is shown in FIG. 30. Separation and repulsion of the playing piece 12 presents no problems when the permanent magnets 21, 22 are mechanically coupled to each other. If such permanent magnets are magnetically coupled to each other, repulsion of the playing piece 12 is more satisfactory if the volume of each of the magnets 21, 22 appreciably exceeds the volume of the permanent magnet or magnets 11 or 11, 11' in the playing piece 12.

FIG. 33 illustrates on a larger scale a detail in the structure which is shown in FIG. *27b*. The main difference between the game of FIGS. *27a–27d* and the game including the structure of FIG. 33 is that the shifting member including the lower permanent magnet 22 of FIG. 33 has an extension 223 which preferably consists of a synthetic plastic material and extends downwardly from the underside of the magnet 22, namely, away from the underside of the bottom wall 31 of the playing board 312. The distance between the underside of the extension 223 and the surface S of the support 700 for the playing board 312 is shown at DB. Such distance is less than the height DR of the fence 311 which surrounds the effective portion of the bottom wall 31. The purpose of the extension 223 is to prevent tilting of the lower permanent magnet 22 with reference to the bottom wall 31. The fence 311 maintains the magnet 22 within the confines of the playing field 1 between the walls 31 and 32. The structure which is shown in FIG. 33 contributes to compactness of the game because it allows for the utilization of a relatively low fence 311. This is due to the fact that the plastic extension 223 prevents the lower magnet 22 from tilting relative to the bottom wall 31 even if the height DR of the fence 311 is negligible. FIGS. *2a–2e* and *27a–27d* illustrate the height of the fences on a somewhat exaggerated scale for the sake of clarity. The feature which is shown in FIG. 33 can be incorporated in the game of FIGS. *1c–1e* and/or FIGS. *2a–2e* and/or FIG. 3 and/or of FIGS. *27a–27b*.

An important feature of the improved game is that the magnet or magnets of the impeller can be used to repel or attract the playing piece(s). This merely depends on the selected distance between the impeller and the playing piece or pieces and contributes significantly to versatility of the improved game. For example, and as discussed in connection with FIGS. 21 and 22, the playing piece can be a replica of a mouse and the impeller can constitute the replica of a cat which attempts to catch and grab the fleeing playing piece. In such games, the impellers are preferably constructed and assembled in a manner as illustrated in FIGS. 16 to 18 or in FIG. 19. If the outlet or outlets 91 of the playing board 312 are opened, they can imitate mouse holes into which the mice (playing pieces 12) can "flee" before the pursuing "cats". This can constitute a minus point for the player who has manipulated the impeller ("cat").

By utilizing the playing piece 12 of FIGS. *23a* and *23b*, the magnetic game of the present invention can be utilized in imitation of a lawman pursuing a bank robber and attempting to retrieve the "loot" 93 on the vehicle of the bank robber. Such game preferably also utilizes one or more impellers of the type shown in FIGS. 16–18 or in FIG. 19.

Still further, the playing field 1 can confine a herd of "sheep" 12 of the type shown in FIGS. *25a* and *25b*. In such games, the impeller or impellers are assumed to constitute dogs attempting to "drive" the herd of playing pieces 12 in a particular direction, for example, to drive a certain number of "sheep" into each of the four outlets 91 shown in FIG. *27a*. If a "dog" (impeller) catches a playing piece 12 of the type shown in FIGS. *25a* and *25b*, this constitutes a minus point for the player manipulating the respective impeller.

Each of the just discussed games can be played by one, two, three or four persons or even by a larger number of persons if the permanent magnets 21, 22 of the impellers are not mechanically coupled to each other. The playing field 1 can be sufficiently large to provide room for a substantial number of playing pieces 12, for example, for a large number of playing pieces which are supposed to represent a herd of sheep.

The versatility of the improved magnetic game is much greater than specifically described heretofore. For example, and as already described in connection with FIGS. 29, 31 and 32, the novel device can be used by two or more players for the playing of a game resembling soccer. The playing piece 12 of FIG. 32 can constitute a hockey puck, the left-hand impeller can perform the function of a goalie, and the right-hand player can perform the function of a forward who is attempting to place the "puck" 12 into the "crate" 81.

As also mentioned before, the insert 85 of FIG. 20 can be used by one or more players to advance one or more playing pieces 12 in imitation of the movements of a skier.

If the playing field 1 receives a different insert 85 which is provided with tracks (for example, with pairs of parallel rails), the improved game can be played by several persons to advance wheel-mounted conveyances (such as the "vehicle" shown in 24) along one or more predetermined paths. For example, such vehicle or vehicles can be caused to advance along an endless path resembling the numeral 8. Alternatively, the path can have the shape of a spiral or any other configuration whose complexity will determine the difficulty in advancing one or more playing pieces therealong.

Numerous other possibilities of using the improved game will ocur to those having the required skill in this art. The number of different inserts which can be placed into the field 1 is practically inexhaustible. Examples of additional plays are imitations of polo, cricket, swimming in predetermined lanes back and forth between the ends of the "swimming pool", kicking field goals in imitation of the game of football, bowling and/or many others.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A magnetic game, comprising a playing board having spaced apart, substantially parallel top and botton walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; and impeller means including a first shifting member situated outwardly adjacent to and manually movable along said top wall, and a second shifting member situated outwardly adjacent to and movable along said bottom wall, said first shifting member comprising a first permanent magnet arranged so that the polar axis thereof is at least nearly perpendicular to said walls, and said second shifting member comprising a second permanent magnet arranged so that the polar axis thereof is at least nearly perpendicular to said walls, said first and second magnets being coupled to one another for movement along the respective walls substantially as a unit, and the polar axes of said first and second magnets being at least substantially coincident all of said magnets having the same direction of magnetization.

2. The game of claim 1, wherein said impeller means further comprises a third shifting member disposed and movable between said walls, said third shifting member including a third permanent magnet arranged so that the polar axis thereof is at least substantially coincident with the polar axes of said first and second magnets, and said third magnet having the same direction of magnetization as, and being magnetically coupled to at least one of, said first and second magnets.

3. The game of claim 2, wherein said third magnet is ring-shaped and has a peripheral flat, said first and second shifting members defining a pocket which is adjacent to said flat and is arranged to accommodate at least a portion of said playing piece.

4. The game of claim 2, wherein said third shifting member has a cylindrical bore extending at substantially right angles to said walls, and first and second rolling elements in said bore respectively contacting said top and bottom walls.

5. The game of claim 1, wherein each of said first and second magnets is in the form of a ring arranged so that the axis thereof is substantially perpendicular to said walls.

6. The game of claim 1, wherein said playing piece has a head part and a rear part, and said one magnet is nearer said head part than said rear part, said playing piece resting on said bottom wall, and the main point of contact of said playing piece with said bottom wall being situated in the region of the center of gravity of said playing peice.

7. The game of claim 1, wherein the magnets of said shifting members are magnetically coupled to one another.

8. The game of claim 1, comprising means for coupling the magnets of said shifting members to one another.

9. The game of claim 1, wherein each of said first and second magnets is a substantially round disc having a flat side adjacent to the respective wall.

10. The game of claim 1, wherein said board further comprises a boundary surrounding said walls and having at least one sealable outlet to permit evacuation of said playing piece from the space between said walls.

11. A magnetic game, comprising a playing board having spaced apart top and bottom walls, and a boundary surrounding said walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; impeller means including a first manually movable shifting member outwardly adjacent to one of said walls, and a second shifting member outwardly adjacent to the other of said walls, said first shifting member comprising a first permanent magent having a polar axis perpendicular to said walls, and said second shifting member comprising a second permanent magnet having a polar axis perpendicular to said walls, said shifting members being in register and movable substantially as a unit along the respective walls to thereby effect movements of said playing piece between said walls, and all of said magnets having the same direction of magnetization; and means for coupling said first and second magnets to one another; said coupling means comprising first and second arms which respectively carry said first and second shifting members, and connector means for securing said arms to ane another in a region outwardly adjacent to said boundary.

12. The game of claim 11, wherein said first shifting member is outwardly adjacent said top wall, and said first arm includes a light-transmitting portion overlying said top wall.

13. The game of claim 12, wherein at least the light-transmitting portion of said first arm consists of a synthetic plastic material.

14. The game of claim 12, further comprising guide means defining an elongated path for said connector means, said arms being turnable about an axis which is defined by said connector means and is perpendicular to said walls so that said shifting members can perform translatory as well as angular movements with reference to the respective walls.

15. The game of claim 14, wherein the boundary of said board has a socket and said guide means includes a portion which is removably received in said socket.

16. The game of claim 11, wherein said connector means includes a separable connection between said arms.

17. A magnetic game, comprising a playing board having spaced apart top a bottom walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; and impeller means including a first manually movable shifting member outwardly adjacent said top wall, and a second shifting member outwardly adjacent to said bottom wall, said first shifting member comprising a first permanent magnet having a polar axis perpendicular to said walls, and said second shifting member comprising a second permanent magnet having a polar axis perpendicular to said walls, said shifting members being in register and movable substantially as a unit along the respective walls to thereby effect movements of said playing piece between said walls, and all of said magnets having the same direction of magnetization, said impeller means further including a third shifting member disposed between said walls intermediate said first and second shifting members, and said third shifting member comprising a third permanent magnet having a polar axis perpendicular to said walls, said third magnet being magnetically coupled to at least one of said first and second magnets.

18. The game of claim 17, wherein at least one of said shifting members comprises at least one rotary element which is in rolling engagement with the adjacent wall.

19. The game of claim 18, wherein said rotary element is arranged to maintain the magnet of the respective shifting member out of direct contact with said adjacent wall and said rotary element comprises a caster.

20. The game of claim 17, wherein said first and said second shifting member comprise registering marginal portions extending beyond the third shifting member so that such marginal portions and said third shifting member define a pocket arranged to receive at least a portion of the playing piece, the distribution of flux lines and poles of said magnets being such that the magnet of the playing piece is repelled when the distance between the magnet of the playing piece and the magnets of said first and said second shifting member exceeds a predetermined value, and that the magnets of the shifting members attract the magnet of the playing piece and urge such playing piece into said pocket when the distance between the magnet of the playing piece and the magnets of said first and said second shifting member is reduced below said value.

21. The game of claim 20, wherein said third shifting member further comprises at least one nonmagnetic component arranged to prevent the playing piece from approaching the third shifting member except by way of said pocket.

22. A magnetic game, comprising a playing board having spaced apart top and bottom walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; and impeller means including a first manually movable shifting member outwardly adjacent to said top wall, and a second shifting member outwardly adjacent to said bottom wall, said first shifting member comprising a first permanent magnet having a polar axis perpendicular to said walls, and said second shifting member comprising a second permanent magnet having a polar axis perpendicular to said walls, said shifting members being in register and movable substantially as a unit along the respective walls to thereby effect movements of said playing piece between said walls, and all of said magnets having the same direction of magnetization, said impeller means further including a third shifting member disposed between said walls, and said third shifting member comprising a disc-shaped third magnet and located between said first and second magnets, said third magnet having a polar axis perpendicular to said walls, and said third magnet being magnetically coupled to at least one of said first and second magnets and having a peripheral flat, said shifting members defining a pocket which is adjacent to said flat and is arranged to accommodate at least a portion of the playing piece.

23. The game of claim 22, wherein said third shifting member further comprises a nonmagnetic component including two jaws flanking said flat and a tail portion extending beyond the first and second magnets substantially diametrically opposite said flat, and a spring bearing against one of said walls and arranged to urge said tail portion against the other of said walls.

24. A magnetic game, comprising a playing board having spaced apart top and bottom walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least perpendicular to said walls; and impeller means including a first manually movable shifting member outwardly adjacent to one of said walls and comprising a first permanent magnet having a polar axis perpendicular to said walls, said impeller means further including a second shifting member, and said second shifting member comprising a second permanent magnet having a polar axis perpendicular to said walls and separated from said first magnet by at least one of said walls, said shifting members being in register and movable substantially as a unit along the respective walls to thereby effect movements of said playing piece between said walls, and all of said magnets having the same direction of magnetization, at least one of said first and second magnets having a substantially circular outline, and the respective shifting member further comprising at least one rotary element in rolling engagement with the adjacent wall, said rotary element being disposed within said circular outline.

25. A magnetic game, comprising a playing board having spaced apart top and bottom walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; and impeller means including a first manually movable shifting member outwardly adjacent to said top wall, and a second shifting member outwardly adjacent to said bottom wall, said first shifting member comprising a first permanent magnet having a polar axis perpendicular to said walls, and said second shifting member comprising a second permanent magnet having a polar axis perpendicular to said walls, said shifting members being in register and movable substantially as a unit along the respective walls to thereby effect movements of said playing piece between said walls, and all of said magnets having the same direction of magnetization, said impeller means further including a third shifting member disposed between said walls intermediate said first and second shifting members, and said third shifting member comprising a third permanent magnet having a substantially circular outline and a polar axis perpendicular to said walls, said third magnet being out of contact with said walls, and said third shifting member being provided with a cylindrical bore extending at right angles to said walls within said circular outline, said third shifting member further comprising first and second spherical rolling elements disposed in said bore and respectively contacting said top and bottom walls.

26. A magnetic game, comprising a playing board having spaced apart top and bottow walls, at least said top wall consisting of light-transmitting material; at least one elongated playing piece disposed between said walls and including at least one permanent magnet nearer to one than to the other end of said playing piece, said playing piece being movable between and along said walls, and said walls being arranged to hold said playing against tilting so that the polar axis of said magnet is invariably at least nearly perpendicular to said walls; and impeller means including a first manually movable shifting member outwardly adjacent to one of said walls and comprising a first permanent magnet having a polar axis perpendicular to said walls, said impeller means further including a second shifting member, and said second shifting member comprising a second permanent magnet having a polar axis perpendicular to said walls and separated from said first magnet by at least one of said walls, said shifting members being in register and movable substantially as a unit along the respective walls to thereby effect movements of said playing piece between said walls, and all of said magnets having the same direction of magnetization.

27. A magnetic game, comprising a playing board having spaced apart top and bottom walls, at least said top wall wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls, said playing piece resembling an animal or a vehicle having a head part and a rear part, and said playing piece further including a caster in the region of said head part, and wheel in the region of said rear part; and impeller means including a first manually movable shifting member outwardly adjacent to one of said walls and comprising a first permanent magnet having a polar axis perpendicular to said walls, said impeller means further including a second shifting member, and said second shifting member comprising a second permanent magnet having a polar axis perpendicular to said walls and separated from said first magnet by at least one of said walls, said shifting members being in register and movable substantially as a unit along the respective walls to thereby effect movements of said playing piece between said walls, and all of said magnets having the same direction of magnetization.

28. The game of claim 27, wherein said one magnet is disposed in the region of said head part, and said head part is narrower than said rear part, said second shifting member being outwardly adjacent to said bottom wall, and said impeller means further comprising a third shifting member disposed between said walls intermediate said one and said second shifting member and having at least one third permanent magnet magnetically coupled to at least one of said first and second magnets and having a polar axis perpendicular to said walls, said first, second and third magnets defining between said walls a pocket which is large enough to permit entry of said head part but too small to permit entry of said rear part.

29. A magnetic game, comprising a playing board having spaced apart top and bottom walls, and a boundary surrounding said walls and including concentric ring-shaped fences extending beyond the exposed sides of said walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; and impeller means including a first manually movable shifting member outwardly adjacent to said top wall, and a second shifting member outwardly adjacent to said bottom wall, said first shifting member comprising a first permanent magnet having a polar axis perpendicular to said walls, and said second shifting member comprising a second permanent magnet having a polar axis perpendicular to said walls, said shifting members being in register and movable substantially as a unit along the respective walls to thereby effect movements of said playing piece between said walls, and said fences limiting the extent of movability of said shifting members along the respective walls, all of said magnets having the same direction of magnetization.

30. A magnetic game, comprising a playing board having spaced apart top and bottom walls, and a boundary surrounding said walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls, said boundary having at least one sealable outlet to permit evacuation of said playing piece from the space between said walls; impeller means including at least one manually movable shifting member outward adjacent to one of said walls and comprising a first permanent magnet having a polar axis perpendicular to said walls, the direction of magnetization of said magnets being identical, and said shifting member being movable along said one wall to thereby effect movements of said playing piece between said walls; and additional permanent magnets in said board and flanking said outlet, the polar axes of said additional magnets being at least substantially perpendicular to said walls, and said additional magnets being disposed at a level between said walls.

31. A magnetic game, comprising a playing board having spaced apart top and bottom walls, and a boundary surrounding said walls and consisting of a synthetic plastic material, said boundary being integral with said bottom wall, and said boundary having at least one supporting leg, and fences adjacent to the outer sides of said walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls, said boundary defining at least one sealable outlet for evacuation of playing pieces from the space between said walls; impeller means including a first manually movable shifting member outwardly adjacent to said top wall, and a second shifting member outwardly adjacent to said bottom wall, said first shifting member comprising a first permanent magnet having a polar axis perpendicular to said walls, and said second shifting member comprising a second permanent magnet having a polar axis perpendicular to said walls, said shifting members being in register and movable substantially as a unit to thereby effect movements of said playing piece between said walls, and said fences limiting the extent of movability of said shifting members along the respective walls, all of said magnets having the same direction of magnetization; and additional permanent magnets in said boundary flanking said outlet and having polar axes perpendicular to said walls.

32. The game of claim 31, wherein said top wall is separable from said boundary and the latter further comprises locating means for maintaining said top wall at a predetermined distance from said bottom wall.

33. The game of claim 31, wherein said boundary has a polygonal outline with a plurality of corners and defines a plurality of sealable outlets each disposed in a different one of said corners.

34. The game of claim 33, further comprising pivotable gates for said outlets.

35. The game of claim 31, wherein said top wall has an inner side, and a recess provided in said inner side in front of said outlet.

36. The game of claim 35, wherein said top wall includes a substantially circular plate and said outlet is elongated and extends substantially radially of said plate, said recess extending transversely of said outlet.

37. The game of claim 35, wherein said top wall includes a substantially circular plate and said outlet is elongated and extends substantially radially of said plate, said recess constituting a slot extending transversely of said outlet.

38. A magnetic game, comprising a playing board having spaced apart top and bottom walls, at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; impeller means including a first manually movable shifting member outwardly adjacent to one of said walls and comprising a first permanent magnet having a polar axis perpendicular to said walls, said impeller means further including a second shifting member, and said second shifting member comprising a second permanent magnet having a polar axis perpendicular to said walls and separated from said first magnet by at least one of said walls, said shifting members being in register and movable substantially as a unit along the respective walls to thereby effect movements of said playing piece between said walls, and all of said magnets having the same direction of magnetization; and an insert disposed between said walls, said insert including a relatively thin panel adjacent to said bottom wall, and at least one projection extending from said panel toward said top wall.

39. The game of claim 38, wherein said insert further includes means defining at least one proposed path for the movements of the playing piece under the influence of said shifting members.

40. The game of claim 38, wherein said projection includes a stop for said playing piece so that the shifting members can be moved with reference to said playing piece when the latter is manipulated by said shifting members into a position of abutment with said stop.

41. A magnetic game, comprising a playing board arranged to be placed onto the surface of a support, said playing board having spaced apart top and bottom walls, and at least said top wall consisting of light-transmitting material; at least one playing piece disposed between said walls and including at least one permanent magnet, said playing piece being movable between and along said walls, and said walls being arranged to hold said playing piece against tilting so that the polar axis of said magnet is invariably at least nearly perpendicular to said walls; and impeller means including a first manually movable shifting member outwardly adjacent to one of said walls and comprising a first permanent magnet having a polar axis perpendicular to said walls, the direction of magnetization of said magnets being identical, and said shifting member being movable along said one wall to thereby effect movements of said playing piece between said walls, said impeller means further including a second shifting member, and said second shifting member comprising a second permanent magnet adjacent to the underside of said bottom wall, and an extension extending downwardly toward but short of the surface of the support so as to prevent tilting of said second shifting member with reference to said bottom wall.

* * * * *